US010747161B2

(12) United States Patent
Nakamura et al.

(10) Patent No.: US 10,747,161 B2
(45) Date of Patent: Aug. 18, 2020

(54) SHEET CONVEYANCE APPARATUS

(71) Applicant: CANON KABUSHIKI KAISHA, Tokyo (JP)

(72) Inventors: Jun Nakamura, Tokyo (JP); So Matsumoto, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 16/038,850

(22) Filed: Jul. 18, 2018

(65) Prior Publication Data

US 2019/0025748 A1 Jan. 24, 2019

(30) Foreign Application Priority Data

Jul. 24, 2017 (JP) ..... 2017-143100

(51) Int. Cl.
*G03G 15/00* (2006.01)
*G03G 15/16* (2006.01)
*G03G 15/08* (2006.01)

(52) U.S. Cl.
CPC ..... *G03G 15/6511* (2013.01); *G03G 15/0865* (2013.01); *G03G 15/1615* (2013.01); *G03G 15/602* (2013.01)

(58) Field of Classification Search
CPC ..... G03G 15/6511; G03G 15/1615; G03G 15/602; G03G 15/0865; G03G 15/2028; G03G 2215/00945
See application file for complete search history.

(56) References Cited

U.S. PATENT DOCUMENTS 4,426,073 A * 1/1984 Mizuma ..... B65H 5/068 271/251
5,167,409 A * 12/1992 Higeta ..... B65H 9/166 271/225

(Continued)

FOREIGN PATENT DOCUMENTS

JP 09-025026 A 1/1997
JP 10-239945 A 9/1998

(Continued)

OTHER PUBLICATIONS

U.S. Appl. No. 16/038,666, Naoki Ishioka So Matsumoto, filed Jul. 18, 2018.

(Continued)

*Primary Examiner* — David H Banh
(74) *Attorney, Agent, or Firm* — Venable LLP

(57) ABSTRACT

A sheet conveyance apparatus includes a first oblique-feed unit and a second oblique-feed unit configured to convey the sheet while approaching the sheet to an abutment surface; a changeover unit configured to change over an abutment pressure of the first oblique-feed unit on the sheet; and a control unit configured to execute a first operation for driving the first oblique-feed unit at a first speed and the second oblique-feed unit at a second speed and a second operation for driving the first oblique-feed unit at a third speed higher than the first speed and the second oblique-feed unit at a fourth speed higher than the second speed after the sheet is abutted against the abutment surface by the first operation. The control unit controls the changeover unit so that the abutment pressure of the first oblique-feed unit in the second operation is higher than that in the first operation.

9 Claims, 24 Drawing Sheets

(56) References Cited

U.S. PATENT DOCUMENTS

| | | | | |
|---|---|---|---|---|
| 6,273,418 | B1 | 8/2001 | Fujikura et al. | |
| 7,658,379 | B2 | 2/2010 | Yasumoto | |
| 7,942,411 | B2 | 5/2011 | Ishioka | |
| 8,123,218 | B2 | 2/2012 | Yasumoto | |
| 8,342,518 | B2 | 1/2013 | Matsumoto | |
| 9,193,546 | B2 | 11/2015 | Nakamura | |
| 9,206,005 | B2 | 12/2015 | Fujita et al. | |
| 9,550,643 | B2 | 1/2017 | Matsumoto et al. | |
| 9,555,992 | B2 * | 1/2017 | Yamashita | B65H 9/166 |
| 2003/0075861 | A1 * | 4/2003 | Sussmeier | B65H 9/166 271/251 |
| 2009/0091075 | A1 * | 4/2009 | Yasumoto | B65H 9/16 271/250 |
| 2010/0327519 | A1 * | 12/2010 | Miyazawa | B65H 5/062 271/248 |
| 2011/0049792 | A1 * | 3/2011 | Suzuki | B65H 5/38 271/226 |
| 2011/0156345 | A1 * | 6/2011 | deJong | B65H 9/002 271/228 |
| 2013/0113158 | A1 * | 5/2013 | Miyazawa | B65H 85/00 271/227 |
| 2014/0191465 | A1 * | 7/2014 | Machamer | B65H 5/068 271/254 |
| 2017/0088375 | A1 | 3/2017 | Matsumoto et al. | |
| 2018/0273325 | A1 * | 9/2018 | Bhide | B65H 9/00 |
| 2019/0023511 | A1 | 1/2019 | Ishioka et al. | |
| 2019/0025749 | A1 | 1/2019 | Iwasaki et al. | |
| 2019/0025750 | A1 | 1/2019 | Matsumoto et al. | |

FOREIGN PATENT DOCUMENTS

| | | | |
|---|---|---|---|
| JP | 11-189355 | A | 7/1999 |
| JP | 2008-050082 | A | 3/2008 |
| JP | 2009-091095 | A | 4/2009 |
| JP | 2015-199551 | A | 11/2015 |

OTHER PUBLICATIONS

U.S. Appl. No. 16/038,862, Hisanori Iwasaki So Matsumoto, filed Jul. 18, 2018.

U.S. Appl. No. 16/038,891, So Matsumoto Koki Sato Daisuke Yamabe, filed Jul. 18, 2018.

* cited by examiner

FIG. 10

| | PRESSURE FORCE AT BUTTING | | | | PRESSURE FORCE AT ACCELERATING | | | |
|---|---|---|---|---|---|---|---|---|
| | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 |
| 60 gsm OR MORE AND LESS THAN 150 gsm | 60 g | 60 g | 60 g | 100 g | 0 g (RELEASE) | 0 g (RELEASE) | 60 g | 100 g |
| 150 gsm OR MORE AND LESS THAN 209 gsm | 80 g | 80 g | 80 g | 120 g | 0 g (RELEASE) | 20 g (RELEASE) | 60 g | 120 g |
| 209 gsm OR MORE AND LESS THAN 256 gsm | 120 g | 120 g | 120 g | 150 g | 0 g (RELEASE) | 60 g | 60 g | 150 g |
| 256 gsm OR MORE AND LESS THAN 300 gsm | 160 g | 160 g | 160 g | 200 g | 60 g | 60 g | 60 g | 200 g |

FIG. 18

| | PRESSURE FORCE AT BUTTING | | | | PRESSURE FORCE AT ACCELERATING | | | |
|---|---|---|---|---|---|---|---|---|
| | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 |
| 60 gsm OR MORE AND LESS THAN 150 gsm | 60 g | 60 g | 60 g | 100 g | 0 g (RELEASE) | 0 g (RELEASE) | 60 g | 100 g |
| 150 gsm OR MORE AND LESS THAN 209 gsm | 80 g | 80 g | 80 g | 120 g | 0 g (RELEASE) | 20 g (RELEASE) | 60 g | 120 g |
| 209 gsm OR MORE AND LESS THAN 256 gsm | 120 g | 120 g | 120 g | 150 g | 0 g (RELEASE) | 60 g | 60 g | 150 g |
| 256 gsm OR MORE AND LESS THAN 300 gsm | 160 g | 160 g | 160 g | 200 g | 60 g | 60 g | 60 g | 200 g |
| 300 gsm OR MORE AND LESS THAN 350 gsm | 160 g | 160 g | 160 g | 200 g | 160 g | 160 g | 160 g | 300 g |

FIG. 20

| | PRESSURE FORCE AT BUTTING | | | | PRESSURE FORCE AT ACCELERATING | | | |
|---|---|---|---|---|---|---|---|---|
| | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 |
| 40 gsm OR MORE AND LESS THAN 60 gsm | 30 g | 30 g | 30 g | 100 g | 0 g (RELEASE) | 30 g | 30 g | 0 g (RELEASE) |
| 60 gsm OR MORE AND LESS THAN 150 gsm | 60 g | 60 g | 60 g | 100 g | 0 g (RELEASE) | 0 g (RELEASE) | 60 g | 100 g |
| 150 gsm OR MORE AND LESS THAN 209 gsm | 80 g | 80 g | 80 g | 120 g | 0 g (RELEASE) | 20 g (RELEASE) | 60 g | 120 g |
| 209 gsm OR MORE AND LESS THAN 256 gsm | 120 g | 120 g | 120 g | 150 g | 0 g (RELEASE) | 60 g | 60 g | 150 g |
| 256 gsm OR MORE AND LESS THAN 300 gsm | 160 g | 160 g | 160 g | 200 g | 60 g | 60 g | 60 g | 200 g |
| 300 gsm OR MORE AND LESS THAN 350 gsm | 160 g | 160 g | 160 g | 200 g | 160 g | 160 g | 160 g | 300 g |

FIG. 23

| | PRESSURE FORCE AT BUTTING AND AT ACCELERATING | | | | | |
|---|---|---|---|---|---|---|
| | FRONT SIDE OBLIQUE-FEED ROLLER 321 | FRONT SIDE OBLIQUE-FEED ROLLER 322 | FRONT SIDE OBLIQUE-FEED ROLLER 323 | BACK SIDE OBLIQUE-FEED ROLLER 311 | BACK SIDE OBLIQUE-FEED ROLLER 312 | BACK SIDE OBLIQUE-FEED ROLLER 313 |
| 40 gsm OR MORE AND LESS THAN 60 gsm | 30 g | 30 g | 30 g | 30 g | 30 g | 30 g |
| 60 gsm OR MORE AND LESS THAN 150 gsm | 60 g | 60 g | 60 g | 60 g | 60 g | 60 g |
| 150 gsm OR MORE AND LESS THAN 209 gsm | 80 g | 80 g | 80 g | 80 g | 80 g | 80 g |
| 209 gsm OR MORE AND LESS THAN 256 gsm | 120 g | 120 g | 120 g | 120 g | 120 g | 120 g |
| 256 gsm OR MORE AND LESS THAN 300 gsm | 160 g | 160 g | 160 g | 160 g | 160 g | 160 g |
| 300 gsm OR MORE AND LESS THAN 350 gsm | 160 g | 160 g | 160 g | 160 g | 160 g | 160 g |
| 350 gsm OR MORE AND LESS THAN 400 gsm | 200 g | 200 g | 200 g | 200 g | 160 g | 160 g |

SHEET CONVEYANCE APPARATUS

BACKGROUND OF THE INVENTION

Field of the Invention

The present invention relates to a sheet conveyance apparatus configured to convey a sheet.

Description of the Related Art

Sheet conveyance apparatuses configured to convey sheets in image forming apparatuses include apparatuses which perform skew-feed correction according to a side registration method with respect to sheets. In such sheet conveyance apparatuses, a sheet is shifted towards the side of a reference member disposed at the side of a sheet conveyance path by an oblique-feed roller, and a side edge of the sheet is caused to abut against the reference member to thereby correct an inclination of the sheet. For example, in Japanese Patent Application Laid-Open No. H11-189355, a sheet alignment apparatus is described that performs skew-feed correction by causing the side edge of a sheet to abut against a reference guide by a plurality of rollers arranged along a sheet conveyance path.

In this connection, with respect to the side registration method, there is a desire to improve the productivity of such apparatuses by causing sheets that have undergone skew-feed correction to move downstream in the sheet conveyance direction as quickly as possible while maintaining the post-skew-feed-correction posture of the sheets.

SUMMARY OF THE INVENTION

Therefore, the present invention provides a sheet conveyance apparatus which improves productivity.

A sheet conveyance apparatus according to one aspect of the present invention, comprising:

an abutment surface extending along a sheet conveyance direction and configured to abut against an edge, in a width direction orthogonal to the sheet conveyance direction, of a sheet which passes through a sheet conveyance path;

a first oblique-feed unit configured to convey the sheet by imparting to the sheet a force in a direction inclined relative to the sheet conveyance direction so that the sheet approaches the abutment surface in the width direction as the sheet proceeds downstream in the sheet conveyance direction;

a second oblique-feed unit disposed at a position closer to the abutment surface compared to the first oblique-feed unit in the width direction and configured to convey the sheet by imparting to the sheet a force in a direction inclined relative to the sheet conveyance direction so that the sheet approaches the abutment surface in the width direction as the sheet proceeds downstream in the sheet conveyance direction;

a first changeover unit configured to change over an abutment pressure of the first oblique-feed unit with respect to the sheet; and a control unit configured to execute a first operation in which the control unit drives the first oblique-feed unit at a first speed and drives the second oblique-feed unit at a second speed to cause the first oblique-feed unit and the second oblique-feed unit to convey the sheet and a second operation in which, after the sheet is abutted against the abutment surface by the first operation, the control unit drives the first oblique-feed unit at a third speed higher than the first speed and drives the second oblique-feed unit at a fourth speed higher than the second speed to cause the first oblique-feed unit and the second oblique-feed unit to convey the sheet, wherein the control unit controls the first changeover unit so that an abutment pressure of the first oblique-feed unit in the second operation is higher than an abutment pressure of the first oblique-feed unit in the first operation.

Further features of the present invention will become apparent from the following description of exemplary embodiments with reference to the attached drawings.

BRIEF DESCRIPTION OF THE DRAWINGS

FIG. 10 is a table illustrating the settings of pressure forces of respective oblique-feed rollers in Embodiment 1.

FIG. 18 is a table illustrating the settings of pressure forces of respective oblique-feed rollers in Embodiment 3.

FIG. 20 is a table illustrating the settings of pressure forces of respective oblique-feed rollers in Embodiment 4.

FIG. 23 is a table illustrating the settings of pressure forces of respective oblique-feed rollers in Embodiment 5.

DESCRIPTION OF THE EMBODIMENTS

Figure 1:
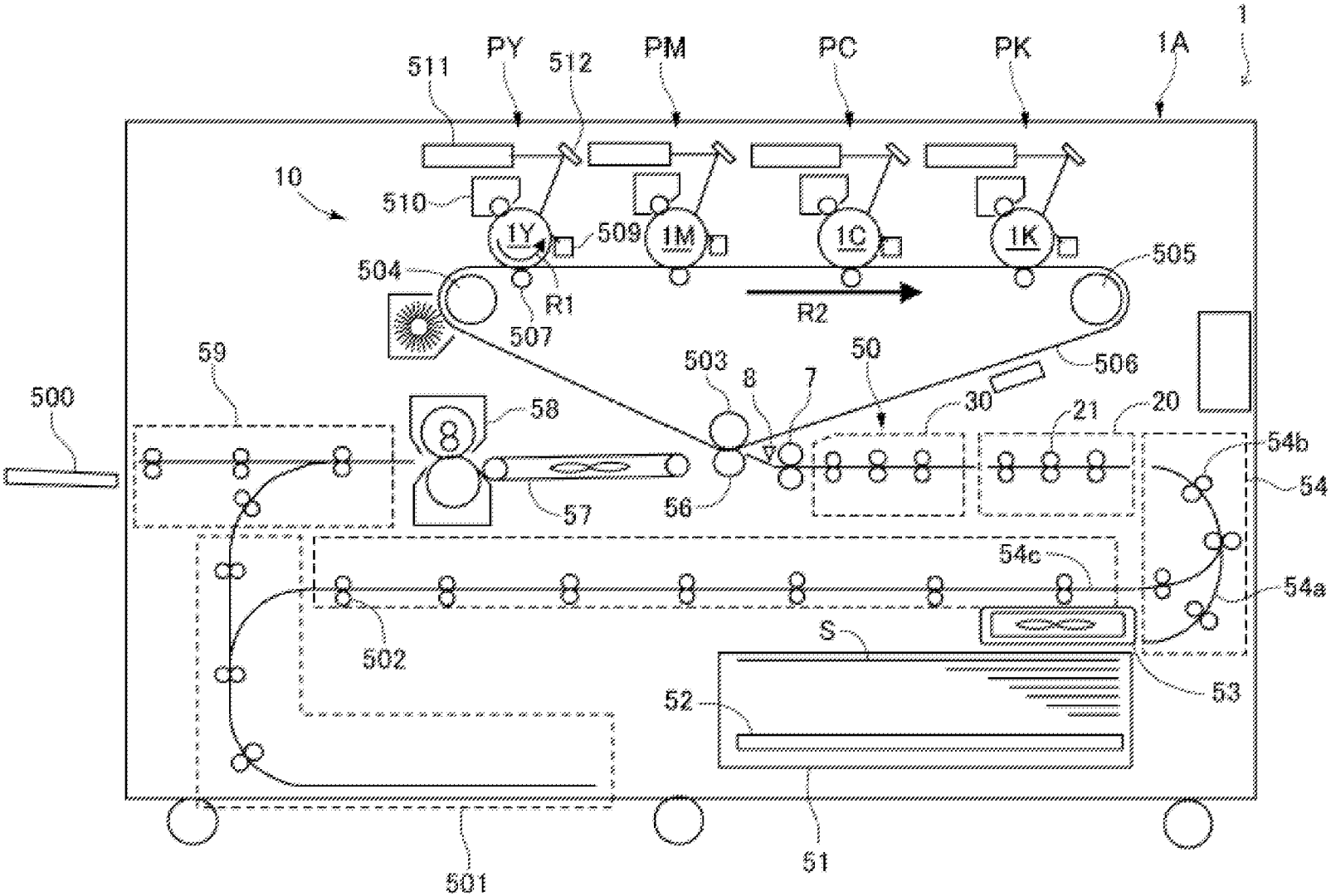
FIG. 1 is a schematic diagram of an image forming apparatus according to the present disclosure.

Hereunder, an image forming apparatus according to the present disclosure will be described referring to the drawings. Image forming apparatuses include printers, copiers, facsimile machines and multifunction peripherals, and form an image on a sheet that is used as a recording medium based on image information that is input from an external PC or image information that is read from an original.

(General Outline of Image Forming Apparatus)

The sheet conveyance apparatus according to the present disclosure constitutes one part of an image forming apparatus 1 that is an electrophotographic full-color laser printer which is illustrated in FIG. 1. The image forming apparatus 1 is a print on demand (POD) machine that is capable of supporting printing for uses other than general office uses, and can use various kinds of sheets such as paper sheets and envelopes, glossy paper, plastic film such as sheet for an overhead projector (OHT), and fabric or the like as recording media. A feeding cassette 51 that houses sheets S, and an image forming engine 10 that forms an image on a sheet S that was fed from the feeding cassette 51 are housed in an apparatus main body 1A of the image forming apparatus 1. The image forming engine 10 that is one example of an image forming unit employs a tandem-type intermediate transfer system that includes four image forming portions PY, PM, PC and PK that form toner images of yellow, magenta, cyan and black, and an intermediate transfer belt 506 that is an intermediate transfer member. The image forming portions PY to PK are electrophotographic units which have photosensitive drums 1Y, 1M, 1C and 1K that are photosensitive members, respectively.

The image forming portions PY to PK have the same configuration as each other except that the colors of the toner which the image forming portions PY to PK use for developing are different from each other. Therefore, the configuration of the image forming portions and the process for forming a toner image (image forming operation) will be described taking the image forming portion PY for yellow as an example. The image forming portion PY includes, in addition to the photosensitive drum 1Y, an exposure device 511, a developing device 510 and a drum cleaner 509. The photosensitive drum 1Y is a drum-like photosensitive member having a photosensitive layer at an outer circumferential portion, and rotates in a direction (arrow R1) along the rotational direction (arrow R2) of the intermediate transfer belt 506. The surface of the photosensitive drum 1Y is charged by being supplied with an electric charge from a charging unit such as a charging roller. The exposure device 511 is configured to emit a laser beam modulated in accordance with image information, and to form an electrostatic latent image on the surface of the photosensitive drum 1Y by scanning the photosensitive drum 1Y by an optical system that includes a reflecting device 512. The developing device 510 contains developer that includes toner, and develops the electrostatic latent image into a toner image by supplying toner to the photosensitive drum 1Y. The toner image formed on the photosensitive drum 1Y is subjected to a primary transfer onto the intermediate transfer belt 506 at a primary transfer portion that is a nip portion between a primary transfer roller 507 that is a primary transfer device and the intermediate transfer belt 506. Toner that remains on the photosensitive drum 1Y after the transfer is removed by the drum cleaner 509.

The intermediate transfer belt 506 is wound around a driving roller 504, a driven roller 505, a secondary transfer inner roller 503 and the primary transfer roller 507, and is rotationally driven in the clockwise rotation direction (arrow R2) in the drawing by the driving roller 504. The aforementioned image forming operation proceeds in parallel at each of the image forming portions PY to PK, and a full-color toner image is formed on the intermediate transfer belt 506 by toner images of four colors being transferred in multiple layers so as to be superimposed on each other. The toner image is carried by the intermediate transfer belt 506 and conveyed to a secondary transfer portion. The secondary transfer portion is configured as a nip portion between a secondary transfer roller 56 as a transfer unit and the secondary transfer inner roller 503, and is a portion at which the toner image is subjected to a secondary transfer onto the sheet S by application of a bias voltage that is of reverse polarity to the charge polarity of the toner to the secondary transfer roller 56. Residual toner which remains on the intermediate transfer belt 506 after the transfer is removed by a belt cleaner.

The sheet S onto which the toner image was transferred is delivered to a fixing unit 58 by a pre-fixing conveyance portion 57. The fixing unit 58 has a pair of fixing rollers that nip and convey the sheet S and a heat source such as a halogen heater. The fixing unit 58 pressurizes and heats the toner image that is being borne on the sheet S. By this means, toner particles melt and adhere to the sheet S to thereby obtain a fixed image that is fixed to the sheet S.

Next, the configuration and operations of a sheet conveyance system that feeds a sheet S stored in the feeding cassette 51, and discharges the sheet S on which an image is formed to outside of the machine body will be described. The sheet conveyance system broadly includes a sheet feeding portion 54, a registration portion 50, a branching conveyance portion 59, a reverse conveyance portion 501, and a two-sided conveyance portion 502.

The feeding cassette 51 is mounted in the apparatus main body 1A in a manner in which the feeding cassette 51 can be drawn out therefrom, and sheets S that are loaded on a raising and lowering plate 52 which is raiseable and lowerable are fed one sheet at a time by a feeding unit 53. A belt system in which a sheet S is sucked onto a belt member by a suction fan and conveyed (see FIG. 1), or a frictional separation system that uses a roller or a pad may be mentioned as examples of the feeding unit 53 that is a sheet feeding unit. The sheet S that is sent out from the feeding unit 53 is conveyed along a feeding path 54*a* by pairs of conveying rollers 54*b* and is delivered to the registration portion 50.

The registration portion 50 includes a pre-registration conveyance portion 20, a skew-feed correction portion 30, and a pair of registration rollers (hereunder, referred to as "registration rollers") 7. The registration portion 50 corrects a skew-feed of the sheet S and conveys the sheet S toward the secondary transfer portion. At this time, based on a detection signal of a registration sensor 8, the registration rollers 7 feed the sheet S into the secondary transfer portion at a timing that is in accordance with the degree of progression of the image forming operations by the image forming portions PY to PK. At the secondary transfer portion, the sheet S onto which the toner image was transferred and for which fixing of an image was performed by the fixing unit 58 is conveyed to the branching conveyance portion 59 which has a changeover member that is capable of switching the conveyance route of the sheet S. In a case where image formation with respect to the sheet S is completed, the sheet S is discharged to a discharge tray 500 disposed on the outside of the apparatus main body 1A by a pair of discharge rollers. In the case of forming an image on the rear face of the sheet S, the sheet S is delivered to the two-sided conveyance portion 502 via the reverse conveyance portion 501. The reverse conveyance portion 501 has a pair of reversing rollers that are capable of forward rotation and reverse rotation, and switches back the sheet S to deliver the sheet S to the two-sided conveyance portion 502. The two-sided conveyance portion 502 conveys the sheet S toward the pre-registration conveyance portion 20 via a re-conveying path 54*c* that merges with the feeding path 54*a*. Subsequently, after an image is formed on the rear face of the sheet S, the sheet S is discharged to the discharge tray 500.

Note that the above described configuration is one example of an image forming apparatus, and the image forming apparatus may also be, for example, an image forming apparatus that includes an image forming unit that adopts an inkjet system instead of an electrophotographic system. Further, some image forming apparatuses also include additional equipment such as an optional feeder or a sheet processing device in addition to the apparatus main body that includes an image forming unit, and the configuration of the sheet conveyance apparatus that is described hereunder may be used for conveying sheets in such kind of additional equipment.

(Side Registration)

Next, correction of a skew-feed of the sheet S by the skew-feed correction portion 30 will be described. The skew-feed correction portion 30 according to the present disclosure is a sheet alignment apparatus that adopts a side registration method. That is, the skew-feed correction portion 30 corrects a skew-feed of a sheet so that a side edge of the sheet follows an abutment surface that extends along the sheet conveyance direction by causing the side edge, that is, an edge in a width direction that is orthogonal to the sheet conveyance direction, of the sheet to abut against a reference member that has the abutment surface. Here, the term "sheet conveyance direction" refers to the conveyance direction of the sheet before the sheet S is shifted towards the side in the direction of the reference member by the skew-feed correction portion 30, and in the present embodiment the term "sheet conveyance direction" is taken as indicating the direction in which the sheet S is conveyed by pairs of conveying rollers 21 of the pre-registration conveyance portion 20.

Figure 24A:
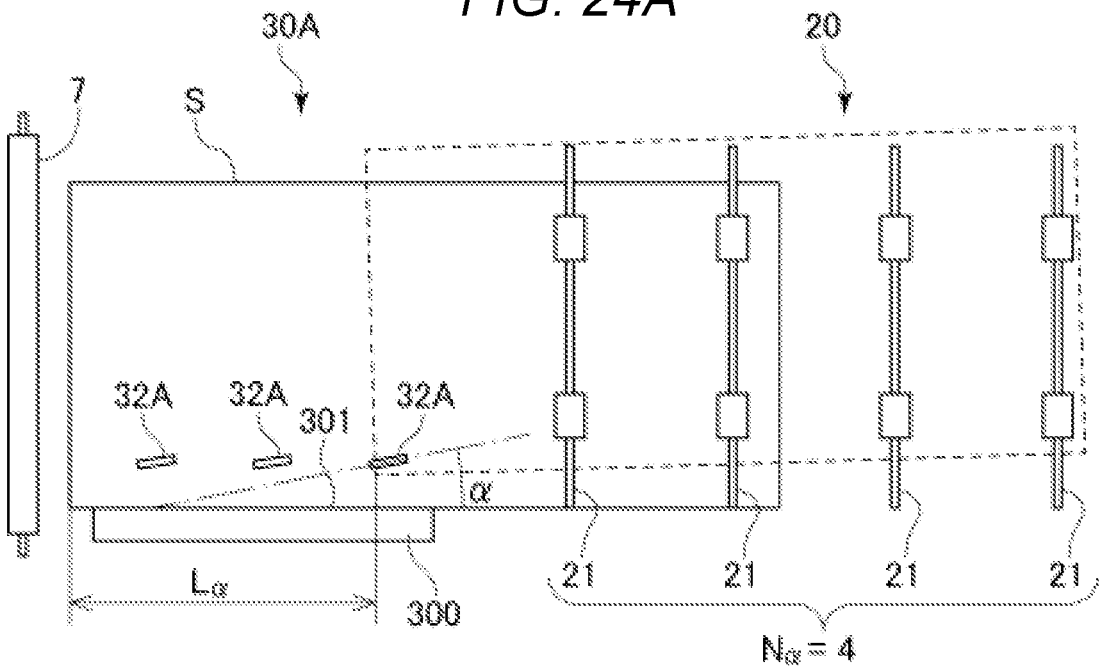
FIG. 24A and FIG. 24B are schematic diagrams for describing angles of oblique-feed rollers according to a side registration method.

A skew-feed correction portion 30A as a reference example that is illustrated in FIG. 24A includes a reference member 300 and one or more oblique-feed rollers 32A that shift the sheet S to the side in the direction toward the reference member 300. Each oblique-feed roller 32A is disposed in a posture that is inclined at an angle $\alpha$ relative to a reference face 301 of the reference member 300 that extends along the sheet conveyance direction (center-left direction in FIG. 24A). The oblique-feed rollers 32A cause a side edge of the sheet S to abut against the reference face 301 by imparting a conveying force that is inclined in the center-left downward direction in FIG. 24A to the sheet S that has been sent downstream in the sheet conveyance direction from the pairs of conveying rollers 21 of the pre-registration conveyance portion 20.

Each pair of conveying rollers 21 of the pre-registration conveyance portion 20 is capable of switching between a pressure state in which the sheet S can be nipped at a nip portion and a separated state in which the nip portion is opened, and are kept in the separated state during a period in which the sheet S is being shifted towards the side by the oblique-feed rollers 32A. This is done to prevent the pairs of conveying rollers 21 from hindering the operation to shift the sheet S towards the side, and also to avoid the occurrence of damage to the sheet S due to friction or stress applied to the sheet S.

In a case where the angle $\alpha$ of the oblique-feed rollers 32A is comparatively small, the sheet S moves in accordance with a small inclination angle relative to the sheet conveyance direction, and is gradually shifted to the side toward the reference member 300. That is, a moving distance $L\alpha$ of the sheet in the sheet conveyance direction during a period from when the oblique-feed rollers 32A start to shift the sheet S toward the side until a side edge of the sheet S abuts against the reference face 301 of the reference member 300 is a large value. However, because it is necessary to enable opening of at least the pair of conveying rollers 21 for which there is a possibility of the sheet S abutting against at the position at which the operation to shift the sheet S to the side starts (see the broken line), the size and degree of complexity of the configuration of the apparatus increases by an amount that corresponds to the mechanical structure that moves the pairs of conveying rollers 21 as well as the control configuration thereof.

In particular, in the case of a long sheet, that is, a sheet in which the ratio between a long side and a short side is large compared to standards that are widely used such as A size and B size sheets, the number of pairs of conveying rollers 21 that it is required to enable opening of is large. For example, in the case of handling a long sheet S having a length from the sheet feeding portion 54 to the skew-feed correction portion 30 in FIG. 1, it is considered that the necessity will arise to separate the pairs of conveying rollers 54*b* of the feeding path 54*a*. Note that, apart from the structure for moving the pairs of conveying rollers, in a section in which a sheet is subjected to oblique feeding, for example, it is necessary to adopt a measure such as avoiding as much as possible curving of the sheet conveyance path to suppress conveying resistance of the sheet, and this leads to an increase in the size and complexity of the apparatus.

Figure 24B:
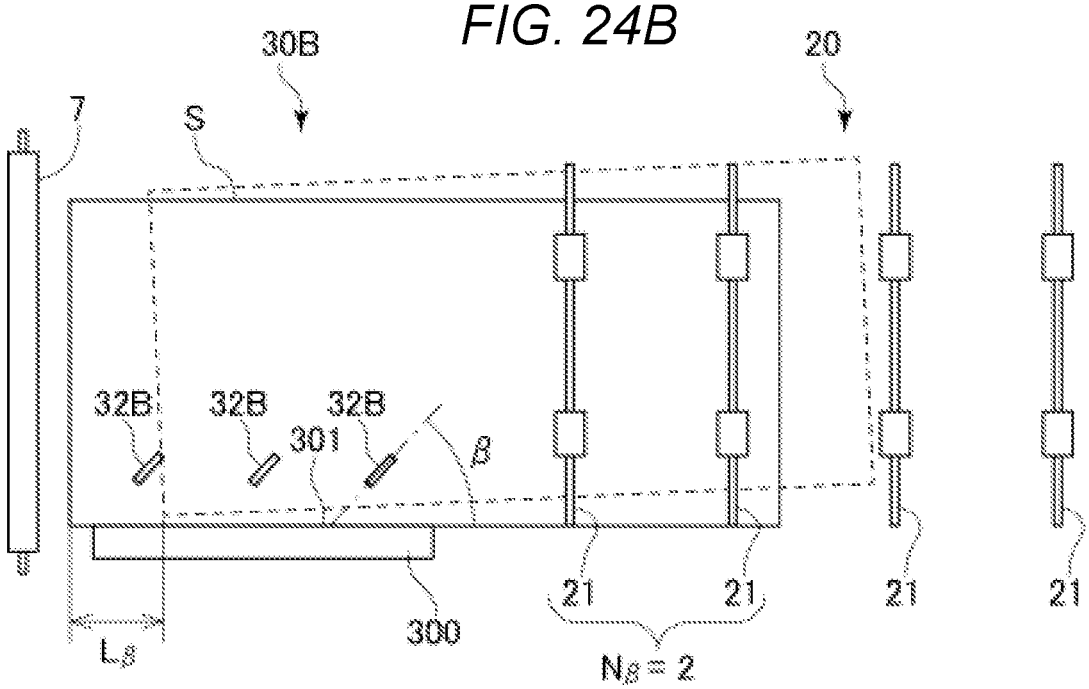

Therefore, it is conceivable to set a large angle $\beta(\beta>\alpha)$ for oblique-feed rollers 32B as illustrated in FIG. 24B. That is, a moving distance $L\beta$ of the sheet in the sheet conveyance direction from when the oblique-feed rollers 32B start to shift the sheet S to the side until a side edge of the sheet S abuts against the reference face 301 of the reference member 300 will be a smaller value than the moving distance $L\alpha$.

The larger that the angle β of the oblique-feed rollers 32B is, the further on the downstream side in the sheet conveyance direction that the position (see broken line) at which to start shifting the sheet S to the side can be set, and hence a configuration for separating some pairs of conveying rollers 21 on the upstream side can be omitted. For example, although it is necessary to separate four of the pairs of conveying rollers 21 (Nα=4) in the example in FIG. 24A, in the example in FIG. 24B it suffices to enable the opening of two of the pairs of conveying rollers 21 (Nβ=2) on the downstream side. However, because the angle β of the oblique-feed rollers 32B is large, the side edge of the sheet S butts strongly against the reference member 300 and there is a concern that buckling of the sheet S may occur.

Therefore, the sheet conveyance apparatus according to the present disclosure overcomes this kind of disadvantage by providing a plurality of oblique-feed units that have different inclination angles with respect to the sheet conveyance direction. Hereunder, the configuration and operations of the sheet conveyance apparatus are described along with specific examples.

Embodiment 1

Figure 2:
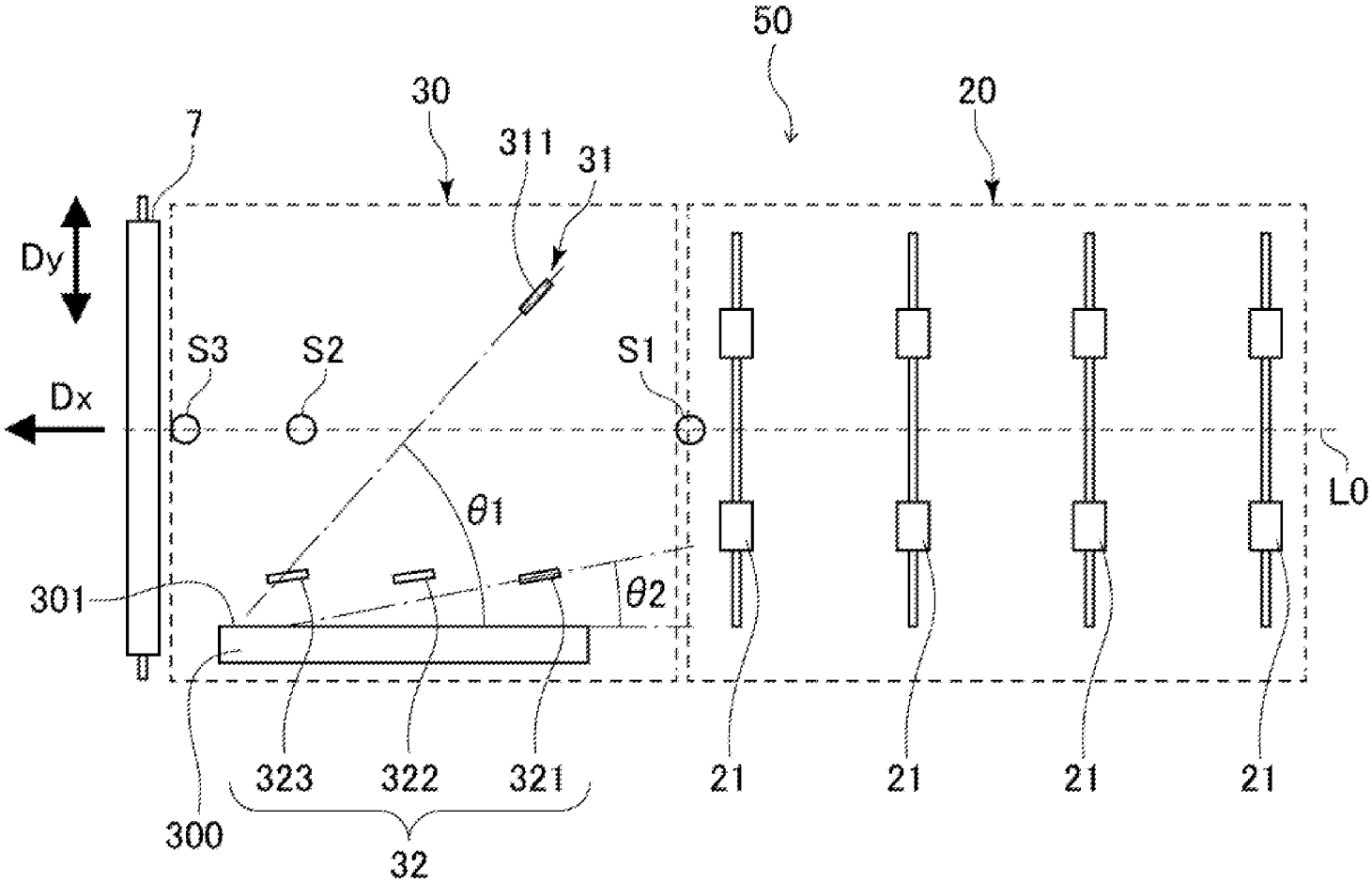
FIG. 2 is a plan view illustrating an outline of a registration portion according to Embodiment 1.

First, the configuration of a registration portion 50 that is a sheet conveyance apparatus according to Embodiment 1 will be described. As illustrated in FIG. 2, the registration portion 50 includes a pre-registration conveyance portion 20 which conveys a sheet in a sheet conveyance direction Dx, a skew-feed correction portion 30 that is disposed downstream of the pre-registration conveyance portion 20, and registration rollers 7 that are disposed downstream of the skew-feed correction portion 30.

The pre-registration conveyance portion 20 has at least one pair (in the present embodiment, four pairs) of conveying rollers 21, and each of the pairs of conveying rollers 21 sends the sheet S in the sheet conveyance direction Dx. The pre-registration conveyance portion 20 conveys the sheet S according to a center reference system, that is, so that the center of the sheet S with respect to a width direction Dy that is orthogonal to the sheet conveyance direction Dx is aligned with a center position (hereunder, referred to as "conveyance center") L0 of the sheet conveyance path. In the case of the present embodiment, the position of the conveyance center L0 is a center position in the width direction Dy of a region in which the pair of conveying rollers 21 are capable of nipping the sheet S, that is, a region where the rollers can contact each other.

A pre-registration sensor Si as a detector for detecting the sheet S is disposed at a position that is in the vicinity of the most downstream pair of conveying rollers 21 and is in the vicinity of the conveyance center L0. For example, a reflection-type photoelectric sensor that has a light emitting portion and a light receiving portion can be used as the pre-registration sensor S1, and in such case a light that is emitted from the light emitting portion upon the sheet S arriving at the detection position is reflected, and the reflected light is detected by the light receiving portion to thereby detect the timing at which the sheet S passes the detection position.

The skew-feed correction portion 30 includes a reference member 300, a back-side oblique-feed unit 31 and a front-side oblique-feed unit 32. Here, the terms "front side" and "back side" express the positional relation in the depth direction when the image forming apparatus 1 is viewed from the front (observation point for FIG. 1). The reference member 300 has a reference face 301 that extends in the sheet conveyance direction Dx, and is disposed on either side of the sheet conveyance path with respect to the width direction Dy. The reference face 301 extends along the sheet conveyance direction, and corresponds to an abutment surface that is capable of abutting against a side edge of a sheet.

The back-side oblique-feed unit 31 is disposed on one side of the conveyance center L0 with respect to the width direction Dy, that is, on the opposite side to the reference member 300, and the front-side oblique-feed unit 32 is disposed on the other side of the conveyance center L0, that is, on the same side as the reference member 300. The front-side oblique-feed unit 32 and the back-side oblique-feed unit 31 each have at least one of oblique-feed rollers 311, 321, 322 and 323, and in the present embodiment one of the oblique-feed rollers 311, 321, 322 and 323 is disposed in the back-side oblique-feed unit 31, and three of the oblique-feed rollers 311, 321, 322 and 323 are disposed in the front-side oblique-feed unit 32.

The oblique-feed rollers 311 and 321 to 323 on the back side and front side each rotate around an axis that is inclined with respect to the width direction Dy. That is, the oblique-feed roller 311 on the back side which corresponds to a first roller (first oblique-feed roller) is disposed so that a tangential direction to a contact portion with respect to the sheet S is a direction that is inclined at an angle θ1 relative to the sheet conveyance direction Dx. Further, the oblique-feed rollers 321 to 323 on the front side that each correspond to a second roller (second oblique-feed roller) are disposed in parallel to each other so that a tangential direction to a contact portion with respect to the sheet S is a direction that is inclined at an angle θ2 relative to the sheet conveyance direction Dx. Accordingly, by each of the oblique-feed rollers 311 and 321 to 323 contacting against the sheet S and rotating, as the sheet S progresses downstream in the sheet conveyance direction Dx, a conveying force is imparted to the sheet S in a direction that is inclined so as to make the sheet S approach the reference face 301 of the reference member 300 in the width direction Dy.

The back-side oblique-feed unit 31 corresponds to a first oblique-feed unit that imparts a conveying force in a first direction that is inclined relative to the sheet conveyance direction to cause the sheet to approach the abutment surface. The front-side oblique-feed unit 32 is disposed at a position that is closer to the abutment surface than the first oblique-feed unit with respect to the width direction, and corresponds to a second oblique-feed unit that imparts a conveying force in a second direction that is inclined relative to the sheet conveyance direction to cause the sheet to sheet to contact against the abutment surface. Further, the respective pairs of conveying rollers 21 and the registration rollers 7 of the pre-registration conveyance portion 20 are each an example of a sheet conveyance unit that is capable of conveying a sheet in the sheet conveyance direction. Among these, the pair of conveying rollers 21 corresponds to a first conveyance unit that delivers a sheet to the first oblique-feed unit and the second oblique-feed unit, and the registration rollers 7 correspond to a second conveyance unit that receives and conveys a sheet that was subjected to oblique feeding by the first oblique-feed unit and the second oblique-feed unit.

In this case, the inclination angle θ1 of the oblique-feed roller 311 on the back side is set to a larger angle than the inclination angle θ2 of the oblique-feed rollers 321 to 323 on the front side (θ1>θ2). That is, a configuration is adopted so that an inclination angle (first angle) relative to the sheet conveyance direction of a force that the first oblique-feed unit imparts to a sheet is greater than an inclination angle (second angle) relative to the sheet conveyance direction of a force that the second oblique-feed unit imparts to a sheet. Note that, a sheet conveying operation of the registration portion 50 and the behavior of the sheets in an apparatus having such a configuration are described in detail later.

In the skew-feed correction portion 30, an oblique-feed sensor S2 and a registration sensor S3 are provided as detectors that can detect the respective sheets S. The oblique-feed sensor S2 is disposed in the vicinity of a position at which a sheet S that is subjected to oblique feeding by the oblique-feed units 31 and 32 with respect to the sheet conveyance direction Dx is expected to contact against the reference member 300. The registration sensor S3 is disposed at a position that is downstream of the oblique-feed sensor S2 and upstream of the registration rollers 7 with respect to the sheet conveyance direction Dx. Similarly to the pre-registration sensor S1, a known sensor such as a reflection-type photoelectric sensor can be used as the oblique-feed sensor S2 and the registration sensor S3.

The registration rollers 7 are capable of sliding in the width direction Dy in a state in which the registration rollers 7 nip the sheet S, and move the sheet S whose side edge had contacted against the reference face 301 of the reference member 300 in the width direction Dy in conformity with the position of an image to be transferred at the secondary transfer portion. Note that the reference member 300 and the front-side oblique-feed unit 32 are also movable in the width direction Dy, and are positioned in advance in accordance with the width of the sheet S that is to be conveyed. Further, a method for performing position adjustment between a sheet and an image to be formed on the sheet is not limited to the foregoing method, and for example a configuration may be adopted which fixes the width direction positions of the reference member 300 and the registration rollers 7, and adjusts the position in the main scanning direction of toner images that the image forming portions PY to PK form.

(Pre-Registration Conveyance Portion)

Figure 3A:
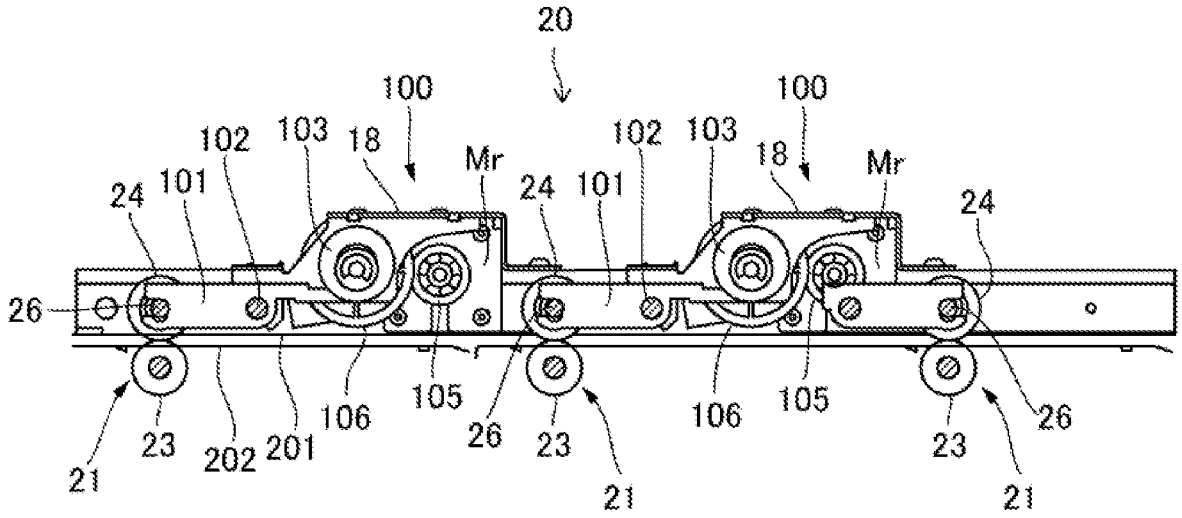
FIG. 3A is a schematic diagram showing the cross-sectional configuration of a pre-registration conveyance portion that is in a pressure state.
Figure 3B:
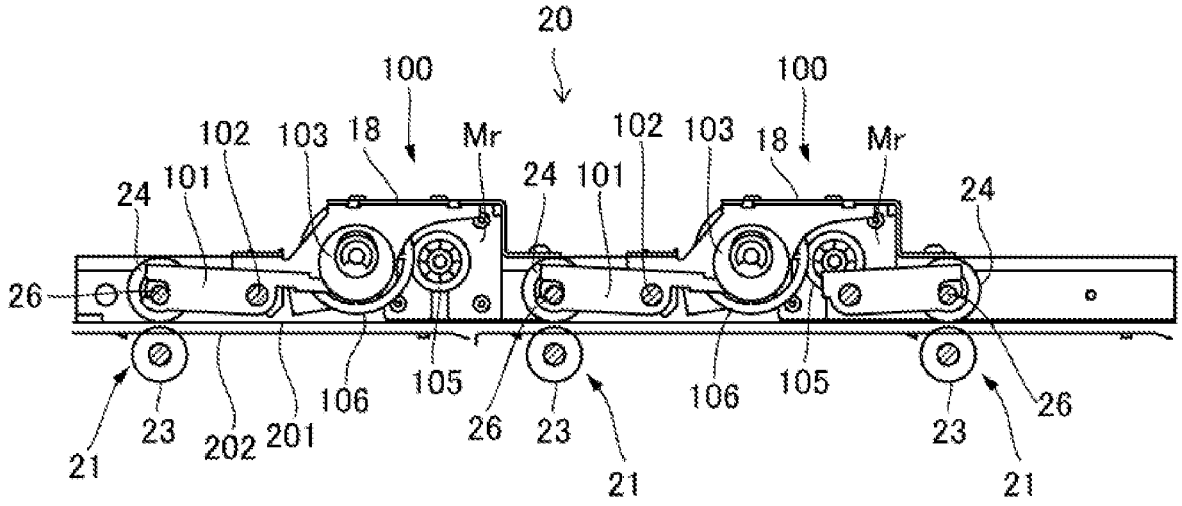
FIG. 3B is a schematic diagram showing the cross-sectional configuration of the pre-registration conveyance portion that is in a released state.
Figure 4:
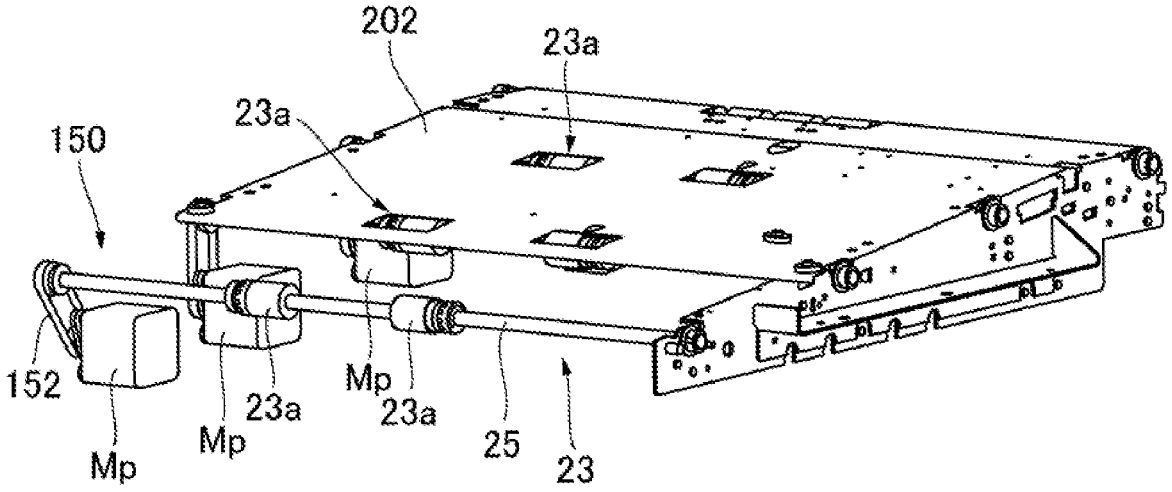
FIG. 4 is a perspective view illustrating the driving configuration of the pre-registration conveyance portion.

The configuration of the pre-registration conveyance portion 20 will be described using FIG. 3A, FIG. 3B and FIG. 4. FIG. 3A and FIG. 3B are schematic diagrams illustrating the cross-sectional configuration of the pre-registration conveyance portion 20. FIG. 4 is a perspective view illustrating the driving configuration of the pair of conveying rollers 21.

As illustrated in FIG. 3A and FIG. 3B, each pair of conveying rollers 21 of the pre-registration conveyance portion 20 is constituted by a driving roller 23 into which a driving force is input, and a driven roller 24 that is driven to rotate by the driving roller 23. At least some of the pairs of conveying rollers 21 are switchable between a pressure state (FIG. 3A) in which the conveying rollers 21 can nip the sheet S at a nip portion and a separated state (FIG. 3B) in which the nip portion is opened. Note that, whether or not to make all of the pairs of conveying rollers 21 switchable between a pressure state and a separated state can be decided in accordance with the maximum size of the sheets S that the image forming apparatus supports.

A cam mechanism 100 having an eccentric roller 103 is provided in the pre-registration conveyance portion 20 as a changeover unit that is capable of switching between a pressure state and a separated state of the pair of conveying rollers 21. The eccentric roller 103 is rotationally driven through gears 105 and 106 by a pre-registration pressure motor Mr as a drive source, and rocks an arm member 101 that contacts against a cam face of an outer circumferential portion. The arm member 101 is rockably supported with respect to a stay member 18 around a rocker shaft 102, and contacts against the eccentric roller 103 on one side of the rocker shaft 102, and supports a driven shaft 26 that is a rotational shaft of the driven roller 24 on the other side. When the arm member 101 rocks, the driven roller 24 enters and exits a sheet conveyance path formed by guide members 201 and 202. Accordingly, the configuration enables switching between a separated state in which the driven roller 24 is separated from the driving roller 23 and a pressure state in which the driven roller 24 presses against the driving roller 23, by controlling the rotational angle of the eccentric roller 103 through a pre-registration pressure motor Mr that is a stepping motor.

As illustrated in FIG. 4, each driving roller 23 is constituted by attaching rubber rollers 23*a* onto a driving roller shaft 25, and is connected to a pre-registration drive motor Mp that is a drive source through a belt power transmission mechanism 152. Each pre-registration drive motor Mp is a stepping motor, and the timings for starting and stopping driving as well as the driving speed (circumferential speed of rubber rollers 23*a*) of the driving roller 23 are changeable.

(Skew-Feed Correction Portion)

Figure 5A:
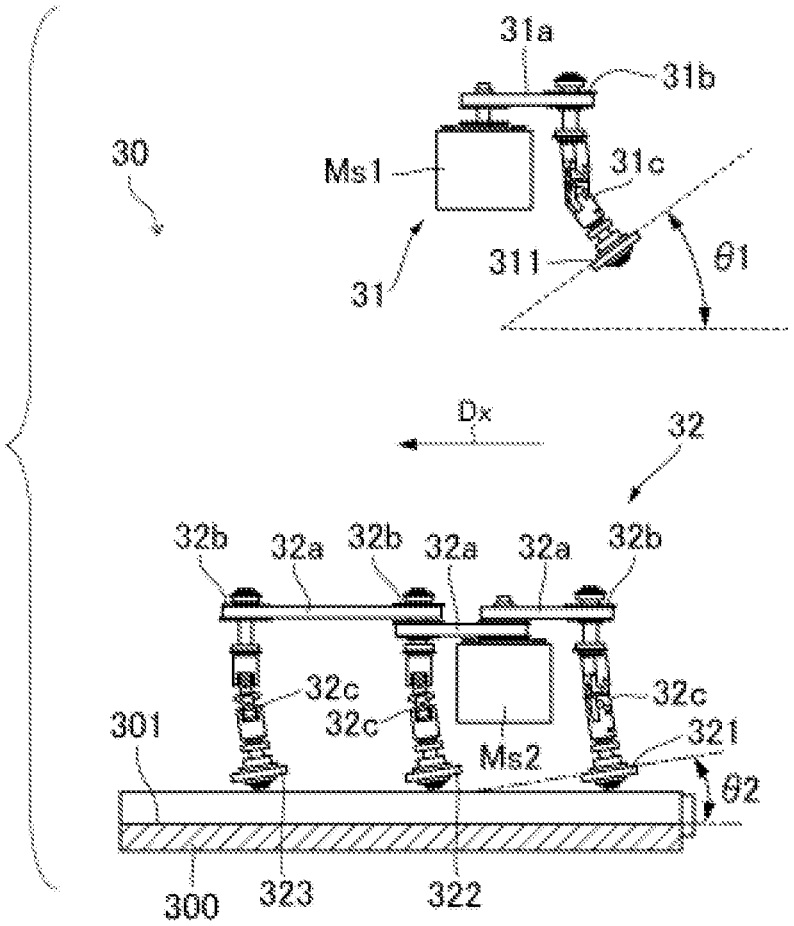
FIG. 5A is a plan view illustrating an outline of a skew-feed correction portion.
Figure 5B:
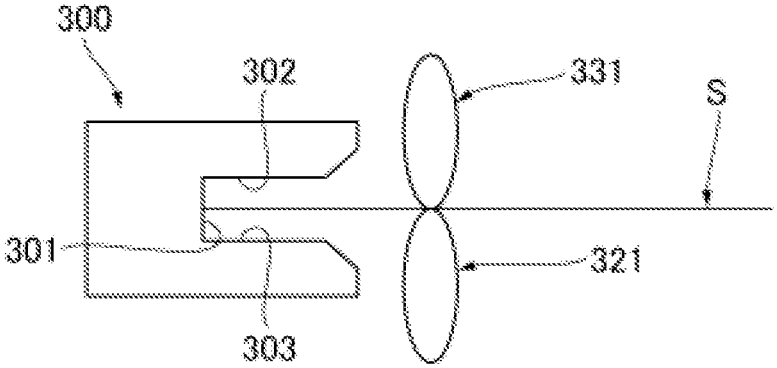
FIG. 5B is a schematic diagram illustrating the cross-sectional configuration of a reference member.
Figure 6A:
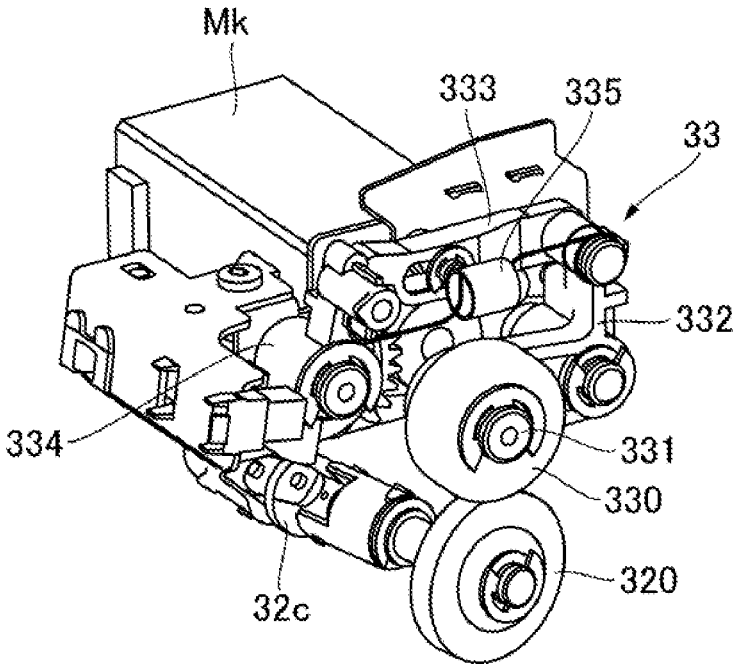
FIG. 6A is a perspective view illustrating a pressing mechanism of an oblique-feed roller.
Figure 6B:
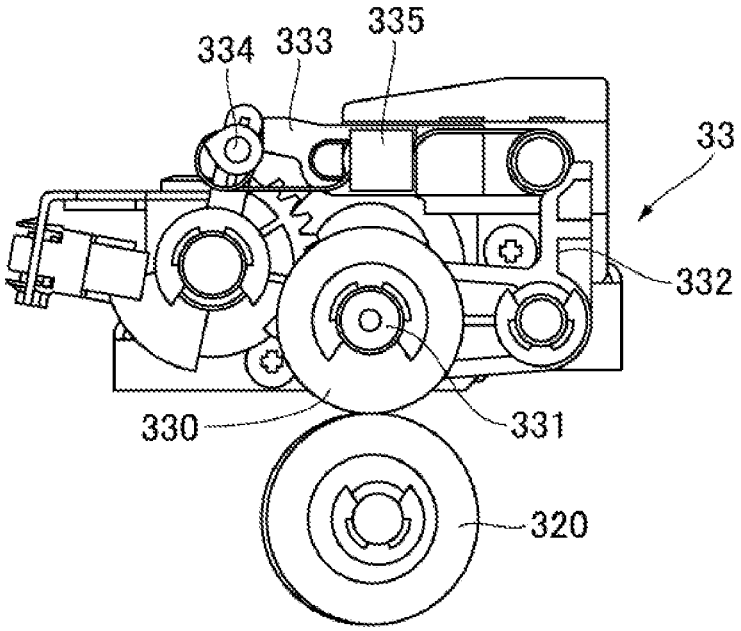
FIG. 6B is a side view illustrating the pressing mechanism of the oblique-feed roller.
Figure 7A:
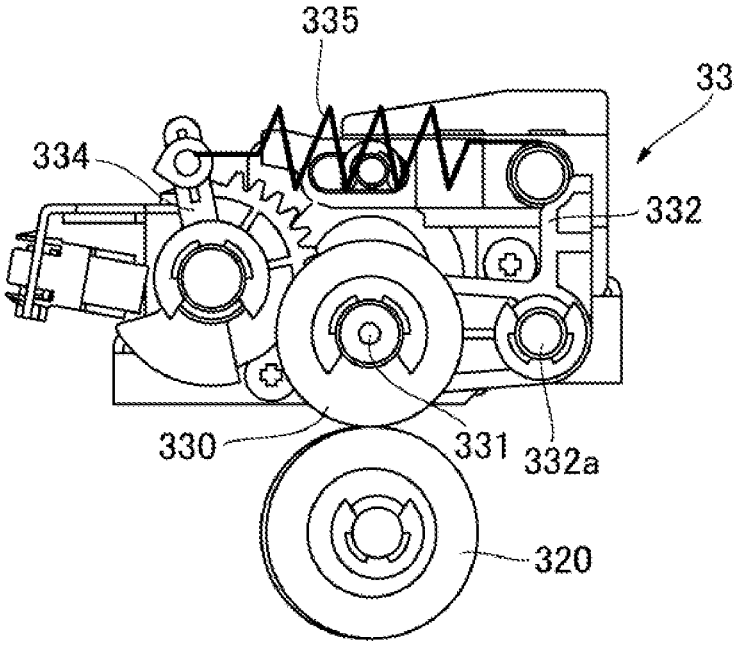
FIG. 7A is a side view illustrating the pressing mechanism in a pressure state.
Figure 7B:
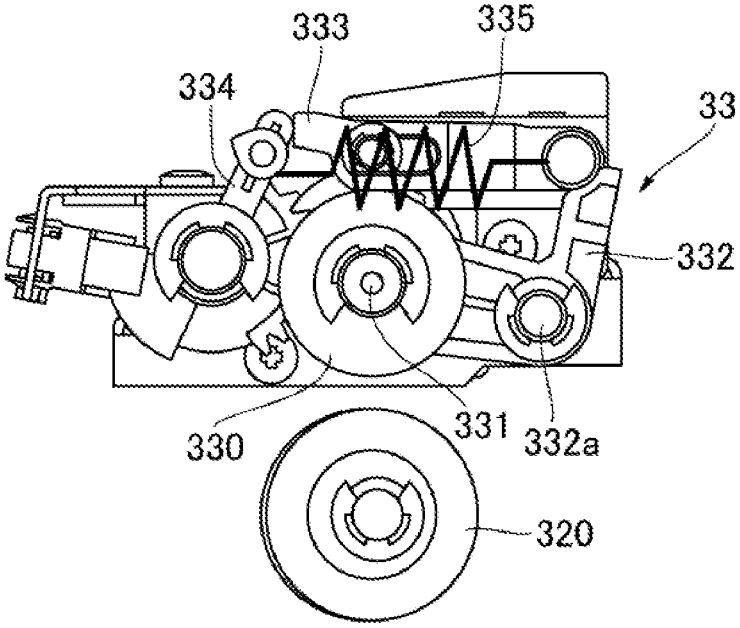
FIG. 7B is a side view illustrating the pressing mechanism in a released state.

Next, the configuration of the skew-feed correction portion 30 will be described in detail using FIG. 5A, FIG. 5B, FIG. 6A, FIG. 6B, FIG. 7A and FIG. 7B. FIG. 5A is a schematic diagram of the skew-feed correction portion 30 as viewed from above. FIG. 5B is a schematic diagram illustrating a cross-sectional configuration of the reference member 300 as viewed from the sheet conveyance direction Dx. FIG. 6A is a perspective view illustrating a pressing configuration of an oblique-feed unit, and FIG. 6B is a side view thereof. FIG. 7A and FIG. 7B are schematic diagrams illustrating a pressure state and a released state of an oblique-feed unit.

As illustrated in FIG. 5A, the rotational axis of the oblique-feed rollers 311 and 321 to 323 on the front side and back side is fixed in an inclined state in conformity with the aforementioned angles θ1 and θ2 using universal joints 31*c* and 32*c*. The respective oblique-feed rollers 311 and 321 to 323 are connected to oblique-feed driving motors Ms1 and Ms2 that are drive sources through a power transmission mechanism that includes the universal joints 31*c*, 32*c*, belts 31*a*, 32*a* and pulleys 31*b*, 32*b*. The oblique-feed driving motors Ms1 and Ms2 are stepping motors, and the driving speed and the timing for starting and stopping driving thereof can be controlled.

As illustrated in FIG. 5B, the reference member 300 has a cross-section that is a concave shape which is constituted by the reference face 301 which a side edge of the sheet S butts against, an upper guide face 302 which faces the upper surface of the sheet S, and a lower guide face 303 which faces the undersurface of the sheet S. A member made of die-cast aluminum in which the reference face 301 is made with accuracy by cutting and in which the reference face 301 is also subjected to an electroless nickel treatment with PTFE (polytetrafluoroethylene) can be suitably used as the reference member 300. By employing such a member, the reference face 301 that has a high degree of flatness and a high level of slipperiness (low frictional resistance with respect to the sheet S) is obtained. Thus, the accuracy of the skew-feed correction of the sheet S can be improved.

As illustrated in FIG. 6A, FIG. 6B, FIG. 7A and FIG. 7B, a pressing mechanism 33 that is capable of switching between a pressure state in which it is possible to nip and convey the sheet S at a nip portion between an oblique-feed roller 320 and a driven roller 330 that faces the oblique-feed roller 320 and a released state in which the pressure state is released is disposed in the skew-feed correction portion 30. Note that, the term "released state" is not limited to a state in which the nip portion is open, and includes a case where rollers contact each other with a weaker force compared to the pressure state. Further, the term "pressure state of the oblique-feed unit" indicates that at least one oblique-feed roller is in a pressure state, and the term "released state of the oblique-feed unit" indicates that all of the oblique-feed rollers are in a released state.

Note that, in the skew-feed correction portion 30 of the present embodiment, in a state in which the oblique-feed roller 320 illustrated in FIG. 6A, FIG. 6B, FIG. 7A and FIG. 7B is replaced with any one of the oblique-feed rollers 311 and 321 to 323, a plurality of sets of the driven roller 330 and the pressing mechanism 33 are disposed. In other words, the pressing mechanism 33 as a changeover unit that is capable of switching between the pressure state and the released state is provided in correspondence with each of the oblique-feed rollers 321 to 323 on the front side (first changeover units), and also in correspondence with the oblique-feed roller 311 on the back side (second changeover unit). Further, in a case where oblique-feed rollers are added to the front-side oblique-feed unit 32 or the back-side oblique-feed unit 31, the pressing mechanism 33 is provided for each of the oblique-feed rollers.

As illustrated in FIG. 6A and FIG. 6B, the pressing mechanism 33 includes an arm member 332, a link member 333, a pressing gear 334, a pressing spring 335, and an oblique-feed pressure motor Mk. The driven roller 330 is supported so as to be rotatable around a driven shaft 331 by the arm member 332, and is movable in a direction to approach or a direction to separate from the oblique-feed roller 320 by rocking of the arm member 332. Although the driven roller 330 in the present embodiment rotates along the sheet conveyance direction around an axis that extends in the width direction, a configuration may also be adopted in which the driven roller 330 is disposed on an axis that is parallel to the corresponding oblique-feed roller. The arm member 332 is connected to the pressing gear 334 through the pressing spring 335 and the link member 333. The pressing gear 334 is connected to an output shaft of the oblique-feed pressure motor Mk that is a drive source.

As illustrated in FIG. 7A, in the pressure state, the pressing gear 334 rotates in the counterclockwise rotation direction in FIG. 7A, and the arm member 332 that is pulled by the pressing spring 335 rocks in the counterclockwise rotation direction around a rocker shaft 332*a*. As a result, a state is entered in which the driven roller 330 presses against the oblique-feed roller 320. On the other hand, as illustrated in FIG. 7B, in the released state, the pressing gear 334 rotates in the clockwise rotation direction in FIG. 7B and presses the link member 333, and the link member 333 causes the arm member 332 to rock in the clockwise rotation direction. As a result, the driven roller 330 separates from the oblique-feed roller 320, and a state is entered in which at least an abutment pressure on the oblique-feed roller 320 is smaller in comparison to the pressure state.

The oblique-feed pressure motor Mk is a stepping motor, and the extension amount of the pressing spring 335 in the pressure state can be changed by controlling the rotational angle of the pressing gear 334. That is, the pressing mechanism 33 according to the present embodiment can perform switching between the pressure state and the released state, and can change a pressure force in the pressure state.

Figure 8:
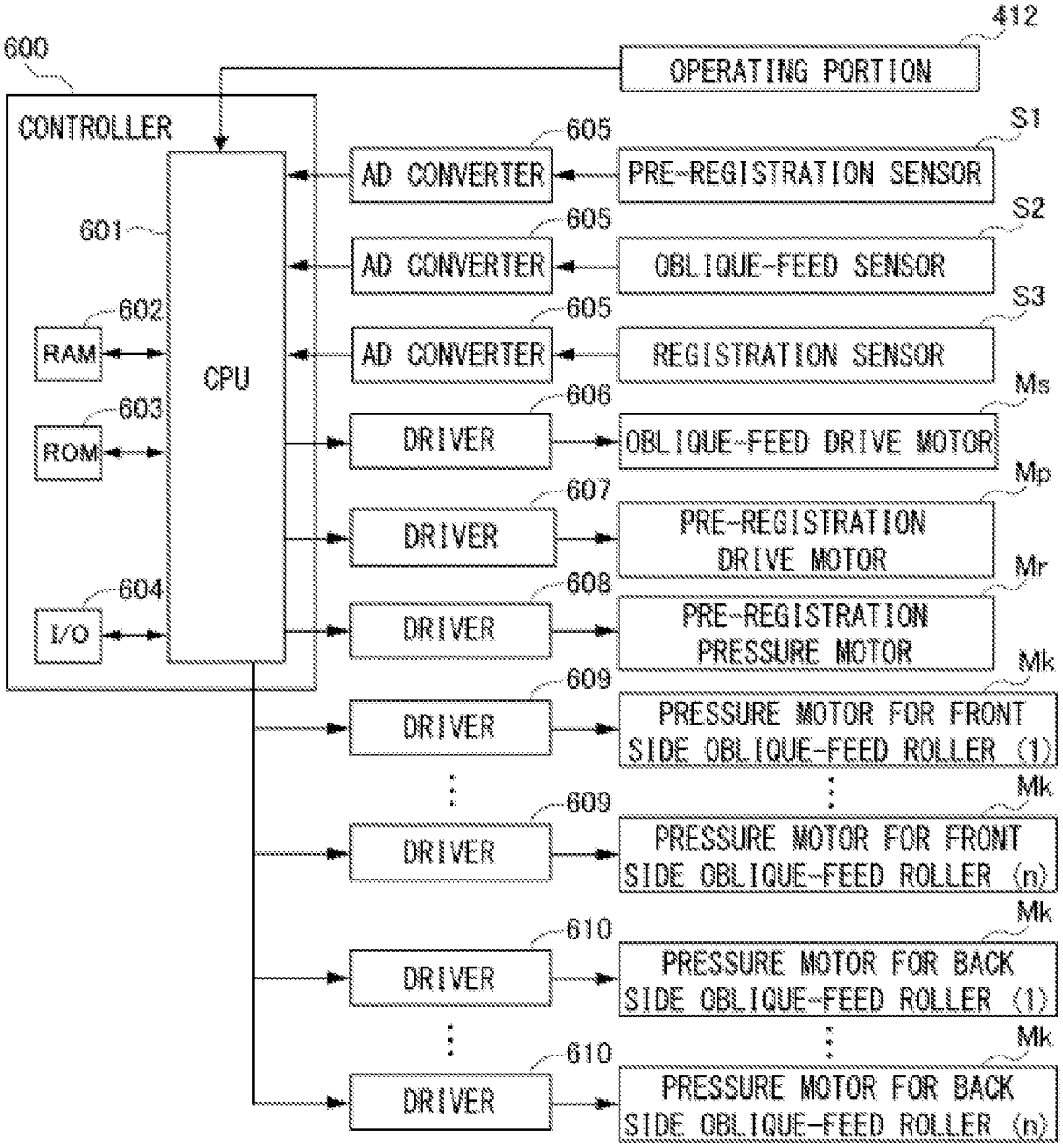
FIG. 8 is a block diagram illustrating a control configuration of a registration portion.

The control configuration of the registration portion 50 will now be described. As illustrated in the block diagram in FIG. 8, operations of the registration portion 50 are controlled by a controller 600 mounted in the image forming apparatus. The controller 600 that is one example of a control unit includes a central processing unit (CPU) 601, a rewritable memory (RAM) 602 and read-only memory (ROM) 603 that are storage units, and an interface (I/O) 604 with respect to an external device or a network.

The CPU 601 performs control based on information that is input through an operating portion 412 that is a user interface, and detection signals received through AD converters 605 from the aforementioned pre-registration sensor S1, oblique-feed sensor S2, and registration sensor S3. The CPU 601 reads out and executes a program stored in the ROM 603 or the like, and controls driving of the group of motors (Ms, Mp, Mr, Mk) that are actuators of the registration portion 50 through drivers 606, 607, 608, 609 and 610. By this means, the CPU 601 is configured to be capable of executing the respective processes of a control method described hereunder. Note that, the oblique-feed pressure motors Mk are provided in a quantity (n) that corresponds to the number of oblique-feed rollers on both the front side and the back side, and the CPU 601 is capable of independently controlling the existence/non-existence of pressing as well as the size of a pressure force of the driven rollers with respect to each oblique-feed roller.

(Registration Portion Control Method)

Figure 9:
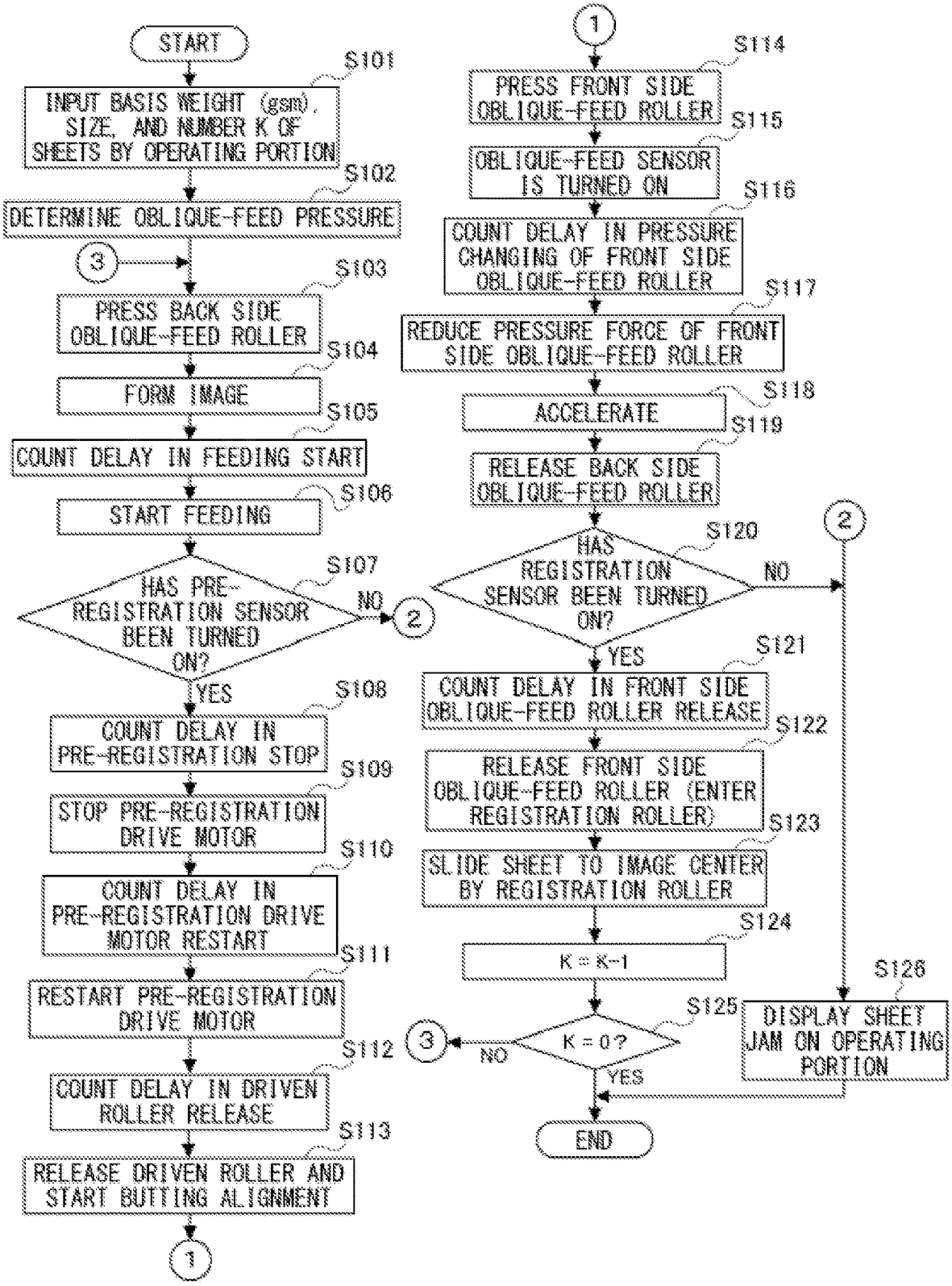
FIG. 9 is a flowchart illustrating a method for controlling a registration portion in Embodiment 1.

Hereunder, a method for controlling a sheet conveying operation in the registration portion 50, and the behavior of a sheet during a sheet conveying operation are described in accordance with a flowchart shown in FIG. 9 while referring as appropriate to FIG. 10, FIG. 11A, FIG. 11B, FIG. 12A, FIG. 12B and FIG. 13. Note that, rollers that are shown by a broken line in FIG. 11A, FIG. 11B, FIG. 12A, FIG. 12B and FIG. 13 represent rollers that are in the released state, and rollers shown by a solid line represent rollers that are in the pressure state. Further, it is assumed that during execution of the flowchart described hereunder, the respective oblique-feed rollers are being rotationally driven continuously.

When an image formation job is started (S101) in a state in which information such as the basis weight, size and number of sheets that are the object of image formation has been input through the operating portion 412, the oblique-feed pressures of the front-side oblique-feed unit 32 and the back-side oblique-feed unit 31 are determined (S102). The term "oblique-feed pressure" refers to a pressure force of the driven roller 330 with respect to each oblique-feed roller, and the oblique-feed pressure is determined for each of the oblique-feed rollers 311 and 321 to 323 based on a table that is stored in advance in the ROM 603 or the like. As illustrated in FIG. 10, the size of the oblique-feed pressure is determined according to the basis weight of the sheet (see column for "pressure force at butting") so as to enable stable conveying irrespective of the kind of sheet. Based on the determined oblique-feed pressure, first, pressing of the oblique-feed roller 311 on the back side is started to enter a pressure state (S103).

Thereafter, when an image forming operation by the image forming portions PY to PK is started (S104), a delay time period until the start of feeding is counted (S105) that is based on the start timing of the image forming operation, and thereafter a sheet is fed from the feeding cassette 51 (S106). Subsequently, upon the pre-registration sensor 51 detecting that a sheet has been delivered to the pre-registration conveyance portion 20 (S107), a stop delay time period is counted (S108), and thereafter the pre-registration drive motor Mp is stopped (S109). Note that, in a case where the pre-registration sensor S1 does not detect a sheet even after a predetermined time period passes from the time that feeding started, a screen indicating there is a sheet jam is displayed on the operating portion (S126), and execution of the job ends.

Thereafter, a delay time period until restarting in conformity with the progress of the image forming operation is counted (S110), and driving of the pre-registration drive motor Mp is restarted (S111). Because the timing for restarting driving by the pre-registration drive motor Mp is adjusted in conformity with the image forming operation, variations in the time period until a sheet arrives at the pre-registration sensor S1 are absorbed. Thereafter, a delay time period until pressing of the pairs of conveying rollers 21 of the pre-registration conveyance portion 20 is released is counted (S112), and then the driven rollers 24 separate from the driving rollers 23 and the respective pairs of conveying rollers 21 enter a separated state (S113). As a result, a butting alignment operation that butts a sheet against the reference member 300 to correct skewness is started. The butting alignment operation in the present embodiment is a period (S113 to S122) from when pressing of the pairs of conveying rollers 21 is released until the oblique-feed units 31 and 32 both enter a released state.

Figure 11A:
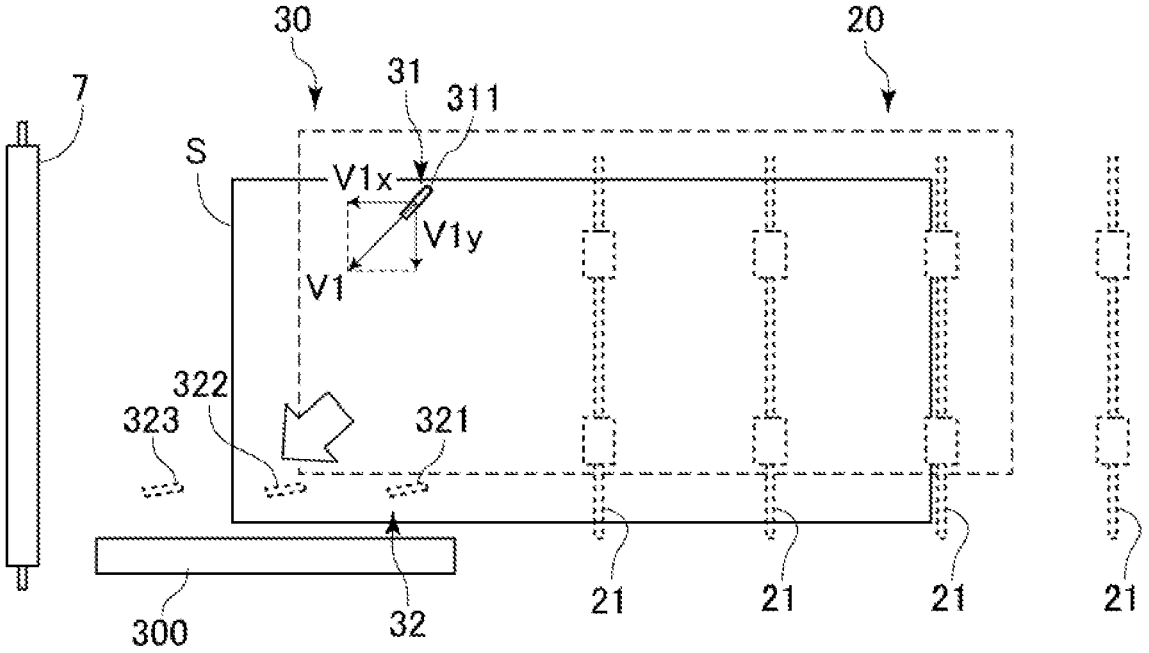
FIG. 11A is a schematic diagram that illustrates a first stage of a butting alignment operation.

Upon pressing of the pair of conveying rollers 21 being released, as illustrated in FIG. 11A, by a conveying force received from the back-side oblique-feed unit 31, the sheet starts to move diagonally relative to the sheet conveyance direction so as to approach the reference member 300. That is, the sheet S is conveyed along a tangential direction of the oblique-feed roller 311 on the back side that is inclined by a comparatively large amount with respect to the sheet conveyance direction Dx, and is quickly shifted to the side in the direction toward the reference face 301 of the reference member 300.

Figure 11B:
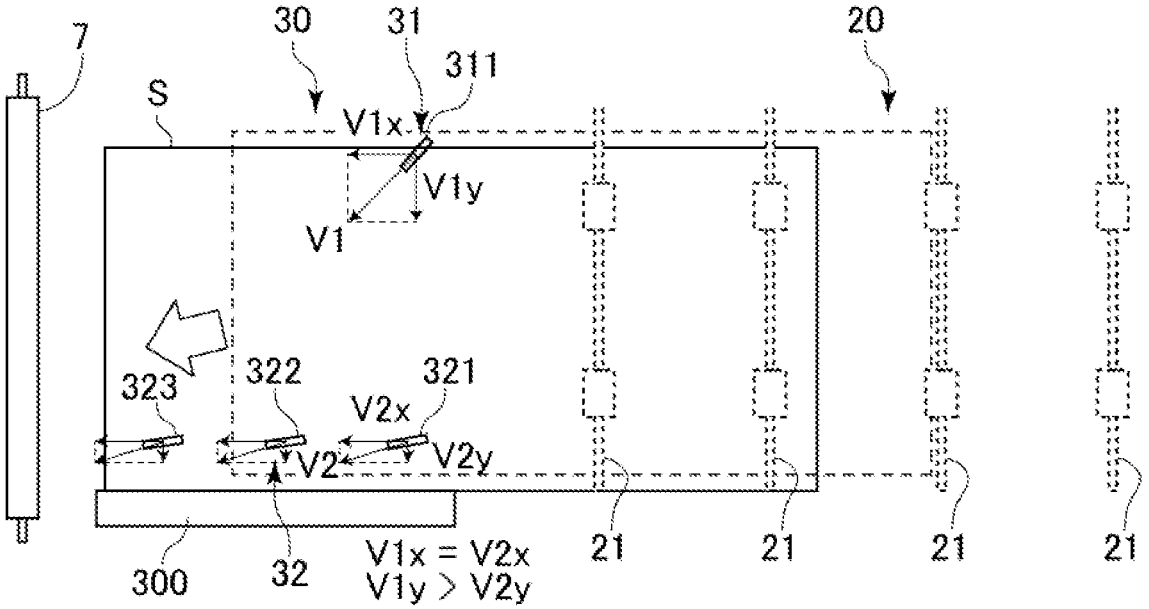
FIG. 11B is a schematic diagram that illustrates a second stage of a butting alignment operation.

Thereafter, at a timing at which the side edge of the sheet has come close to the reference face 301 of the reference member 300 to a certain extent, pressing of the oblique-feed rollers 321 to 323 on the front side is started based on the oblique-feed pressure that was already determined (S114). That is, after an oblique-feed operation with respect to the sheet was started by the back-side oblique-feed unit 31, by starting pressing of the front-side oblique-feed unit 32 by the pressing mechanism 33, an oblique-feed operation by the front-side oblique-feed unit 32 is started. Thereupon, as illustrated in FIG. 11B, the sheet S that is nipped by the oblique-feed rollers 321 to 323 comes even closer to the reference member 300, and the side edge of the sheet S abuts against the reference face 301. That is, the sheet S is conveyed along a tangential direction of the oblique-feed rollers 321 to 323 on the front side that are inclined by a relatively small amount with respect to the sheet conveyance direction Dx, and contact against the reference face 301 in a state in which the moving velocity in the width direction Dy is decelerated. By this means, the force that the sheet S receives when the side edge of the sheet S strikes against the reference face 301 is lessened and buckling of the sheet S is prevented.

Note that, the actual movement direction of the sheet does not necessarily match a tangential direction of the oblique-feed rollers because slippage occurs at the oblique-feed roller due to inertia of the sheet and the influence of conveying resistance with respect to the sheet and the like. However, by setting an inclination angle with respect to the sheet conveyance direction in the direction of a conveying force that the back-side oblique-feed unit 31 imparts to the sheet to a large value in comparison to the front-side oblique-feed unit 32, the point that the sheet S can be quickly shifted to the side while preventing buckling of the sheet S does not change.

Further, instead of a configuration in which sheets are passed between the oblique-feed units by switching between the presence/absence of pressing of the oblique-feed rollers, a configuration may be adopted in which passing of sheets is performed by the positional relation between the oblique-feed units. For example, in a case where the back-side oblique-feed unit is disposed further upstream than the front-side oblique-feed unit in the sheet conveyance direction, the force of an impact between the sheet and the reference member can be lessened by the front-side oblique-feed unit while quickly shifting the sheet toward the side of the reference member by the back-side oblique-feed unit. However, by adopting a configuration so that the areas in which the oblique-feed rollers of the front-side oblique-feed unit 32 and the back-side oblique-feed unit 31 are disposed are such that the oblique-feed rollers at least partially overlap when viewed from the width direction as in the present embodiment, the skew-feed correction portion can be made compact.

The description will now continue referring again to the flowchart in FIG. 9. After pressing of the oblique-feed rollers 321 to 323 on the front side starts, upon the oblique-feed sensor S2 detecting the front end of the sheet, that is, the downstream end in the sheet conveyance direction (S115), a delay time period for changing the pressure force of the oblique-feed rollers 321 to 323 is counted (S116). The length of the aforementioned delay time period is set so that changing of the pressure force is executed after the side edge of the sheet contacts against the reference face 301 of the reference member 300. In the present embodiment, after the delay time period elapses, processing that decreases the pressure force of the oblique-feed rollers 321 to 323 on the front side is executed (S117). The pressure force of the respective oblique-feed rollers after decreasing the pressure is determined by referring to a table stored in the ROM or the like (see the "pressure force at accelerating" column in FIG. 10). Next, processing that increases the conveying speed of the front-side oblique-feed unit 32 and the back-side oblique-feed unit 31 is performed (S118).

Figure 12A:
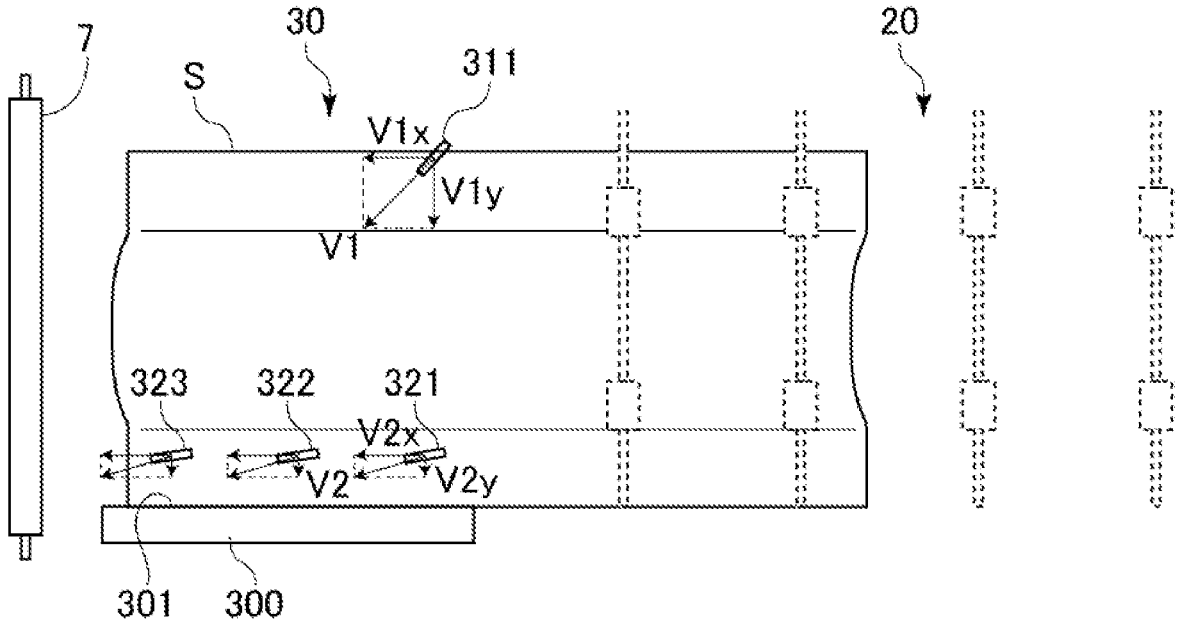
FIG. 12A is a schematic diagram that illustrates the formation of a loop in a sheet by the butting alignment operation.
Figure 12B:
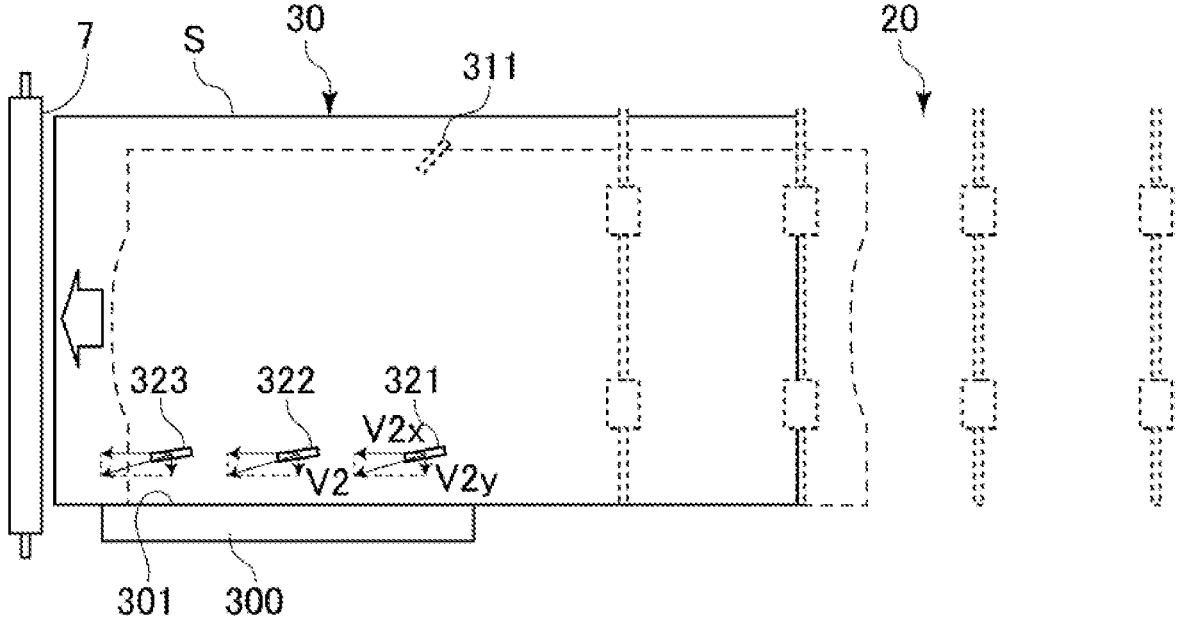
FIG. 12B is a schematic diagram that illustrates elimination of a loop in a sheet by the butting alignment operation.

At a timing that is set so as to be after acceleration is completed and prior to detection of the front end of the sheet by the registration sensor S3, pressing of the oblique-feed roller 311 on the back side is released and the oblique-feed roller 311 enters a released state (S119). As described above, the inclination angle with respect to the sheet conveyance direction Dx of the oblique-feed roller 311 on the back side is large compared to the oblique-feed rollers 321 to 323 on the front side, and a force from the oblique-feed roller 311 to cause the sheet to approach the reference member 300 with respect to the width direction Dy is relatively large ($V1y>V2y$). Therefore, as illustrated in FIG. 12A, during a period in which the back-side oblique-feed unit 31 and the front-side oblique-feed unit 32 are in a pressure state, there is a possibility that a loop may be formed in the sheet in a region between the units in the width direction Dy. If the front end of the sheet enters the nip portion of the registration rollers 7 while a loop is formed in the sheet, the loop will be crushed and there is a possibility that creases will arises or that the posture of the sheet will be disturbed accompanying elimination of the loop and consequently the sheet will be skewed. In the present embodiment, as illustrated in FIG. 12A, because the back-side oblique-feed unit 31 is switched to a released state before the sheet enters the registration rollers 7, the occurrence of such kind of inconvenience is avoided.

Upon the registration sensor S3 detecting the front end of the sheet (S120), a delay time period for releasing the oblique-feed rollers 321 to 323 on the front side is counted (S121), and then the pressing of the oblique-feed rollers 321 to 323 is released and the oblique-feed rollers 321 to 323 enter a released state (S122). The aforementioned delay time period is set so that the oblique-feed rollers 321 to 323 on the front side enter a released state after the front end of the sheet enters the nip portion of the registration rollers 7. In other words, in the front-side oblique-feed unit 32, the pressure is released after the sheet front end passes the detection position (second detection position) of the registration sensor S3 that is a second detector. On the other hand, the back-side oblique-feed unit 31 is configured so that the pressure is released at a timing that is after the sheet front end passes the detection position (first detection position) of the oblique-feed sensor S2 that is a first detector and is before the sheet front end passes the second detection position. Note that, if the registration sensor S3 does not detect a sheet within a predetermined time period, a screen indicating there is a sheet jam is displayed on the operating portion (S126), and execution of the job ends.

Figure 13:
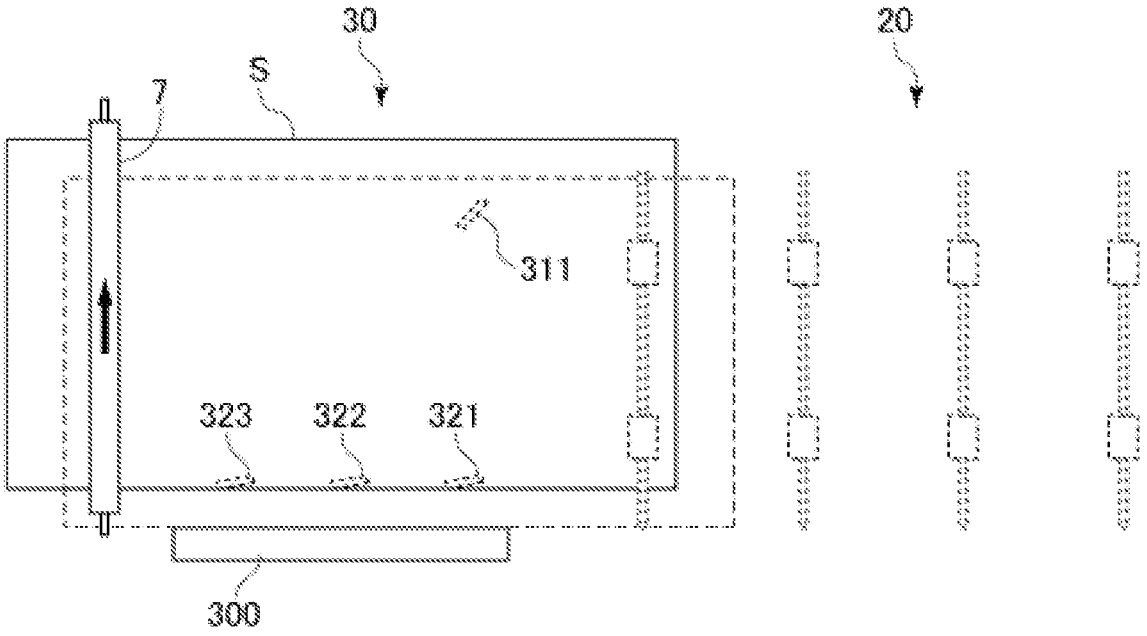
FIG. 13 is a schematic diagram that illustrates a position adjustment operation with respect to a sheet by a pair of registration rollers.

When the sheet is delivered to the registration rollers 7, as illustrated in FIG. 13, the registration rollers 7 move in the width direction while conveying the sheet. By this means, the center position of the sheet in the width direction Dy is positioned in alignment with the center position of the image formed by the image forming portions PY to PK (S123). Upon the sheet being sent to the secondary transfer portion, a counter that manages the number of remaining sheets K that are to be subjected to image formation decrements the value of K (S124). If the number of remaining sheets K is not 0, that is, if sheets that are to be subjected to image formation remain (NO in S125), the above described operations (S103 to S124) are repeated. At such time, in the pre-registration conveyance portion 20, by the pairs of conveying rollers 21 through which the rear end of the leading sheet passed being pressed in sequence, sheets are continuously conveyed and supplied to the secondary transfer portion. When the number of remaining sheets K is 0 (YES in S125), it is determined that the image forming operation is completed, and execution of the job ends.

Thus, in the present embodiment, the back-side oblique-feed unit 31 having the oblique-feed roller 311 for which an inclination angle with respect to the sheet conveyance direction Dx is relatively large, and the front-side oblique-feed unit 32 having the oblique-feed rollers 321 to 323 for which an inclination angle is relatively small are used in combination. In other words, a first oblique-feed unit that imparts a force in a first direction that causes the sheet to approach the abutment surface of the reference member, and a second oblique-feed unit that imparts a force in a second direction for which an angle with respect to the sheet conveyance direction is small in comparison to the first direction are provided. Because the sheet is shifted to the side towards the abutment surface in a short distance by the first oblique-feed unit, an increase in the size and complexity of the sheet conveyance apparatus can be suppressed. Further, since the sheet is decelerated by the second oblique-feed unit, buckling of the sheet can be prevented.

Note that, if the inclination angle θ1 of the oblique-feed roller on the back side is made large, although it is possible to shift sheets towards the side in a shorter conveying distance, on the other hand the difference with the inclination angle θ2 of the oblique-feed rollers on the front side increases and looping of sheets is liable to occur between the oblique-feed rollers on the front side and back side. Further, the larger that the inclination angle θ1 is, the greater the difference with the sheet conveyance direction that is generated by the pre-registration conveyance portion, and there is a possibility that sheets will be subjected to rubbing at the time of delivery and the sheets will be damaged. For such reasons, the inclination angle θ1 can be set in the range of 20 to 40 degrees, and more preferably can be set in the range of 25 to 35 degrees. Further, the inclination angle θ2 of the oblique-feed rollers on the front side is preferably small enough to enable sufficient deceleration, with respect to the width direction, of the sheet that is shifted towards the side by the oblique-feed roller on the back side. For this reason, for example, the inclination angle θ2 can be set to an angle that is not more than one-half of the inclination angle θ1, and as one example it is favorable to make θ1=30° and θ2=10°.

(Setting of Conveying Speed)

Figure 14A:
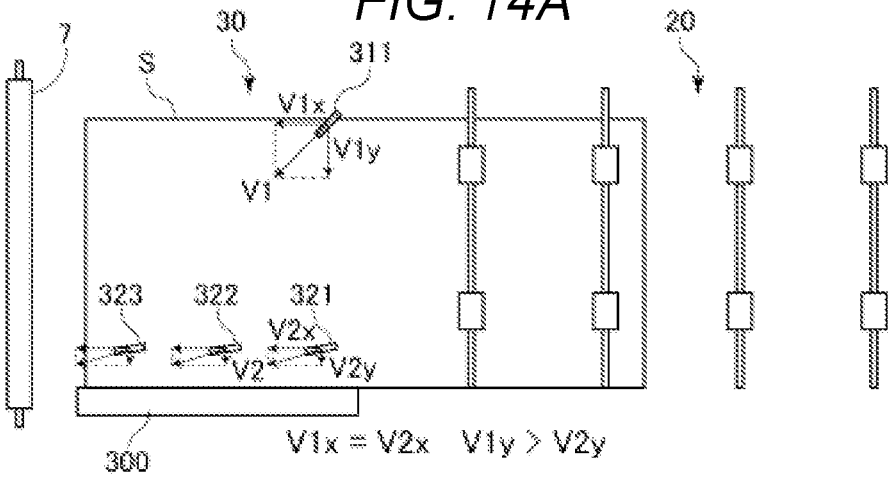
FIG. 14A is a schematic diagram for describing the magnitude relation between conveying speeds of oblique-feed rollers and the behavior of a sheet in Embodiment 1.
Figure 14B:
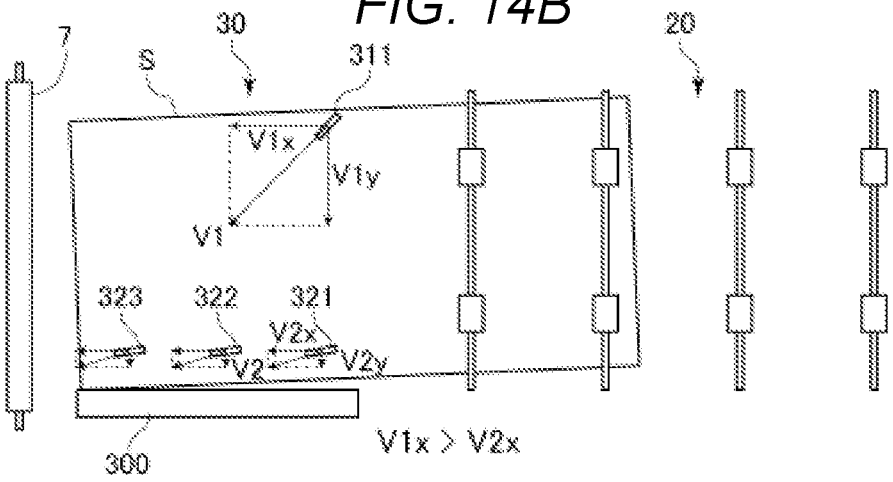
FIG. 14B and FIG. 14C are schematic diagrams for describing the magnitude relation between conveying speeds of oblique-feed rollers and the behavior of a sheet in a reference example.
Figure 14C:
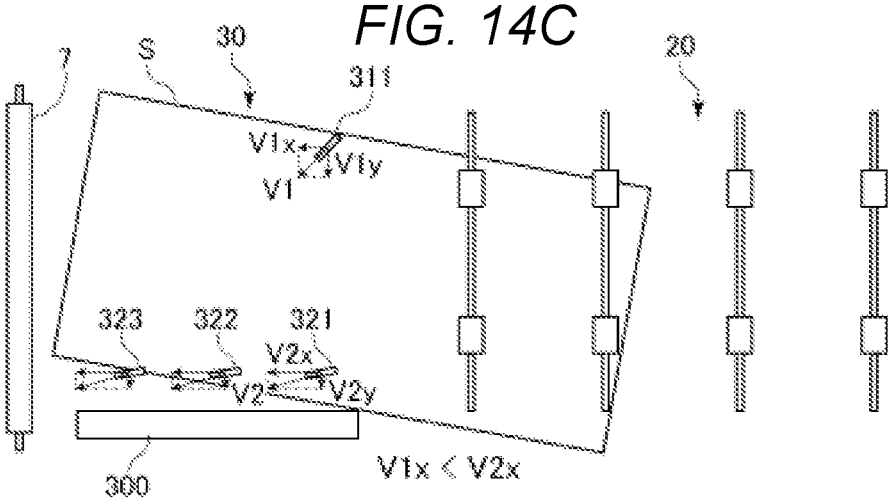

Setting of the conveying speed of the sheet in the skew-feed correction portion 30 will now be described in detail. Referring to FIG. 14A, FIG. 14B and FIG. 14C, hereunder, with respect to each of the oblique-feed rollers 311 and 321 to 323, circumferential speeds at a contact portion with the sheet S are referred to as oblique-feeding velocities V1 and V2 of the oblique-feed rollers to distinguish these speeds from the actual conveying speed of the sheet. Further, the components in the sheet conveyance direction Dx of the oblique-feeding velocities V1 and V2 are denoted by V1$x$ and V2$x$, and the components in the width direction Dy are denoted by V1$y$ and V2$y$. Note that, in the present embodiment, the size and direction of the oblique-feeding velocity V2 are set equally for each of the oblique-feed rollers 321 to 323 of the front-side oblique-feed unit 32.

In the present embodiment, the oblique-feeding velocities V1 and V2 of the oblique-feed rollers 311 and 321 to 323 on the front side and back side are set so that the components thereof in the sheet conveyance direction Dx become equal (V1$x$≈V2$x$; see FIG. 14A). For instance, in a case where the velocities in the sheet conveyance direction Dx are not equal between the oblique-feed units on the front side and back side (V1$x$>V2$x$ or V1$x$<V2$x$; see FIG. 14B and FIG. 14C), a force that attempts to swivel the sheet S arises. That is, a force that causes a side edge of the sheet S that is closer to the oblique-feed unit having the higher velocity in the sheet conveyance direction Dx to advance downstream in the sheet conveyance direction Dx faster than the other side edge acts on the sheet S. Therefore, in the present embodiment the oblique-feeding velocities V1 and V2 are set so that the components thereof in the sheet conveyance direction Dx approximately match at least during a period in which the oblique-feed rollers on both the front side and back side are in a pressure state (S114 to S119). By this means, turning of the sheet S that is attributable to a difference in the velocities in the sheet conveyance direction Dx of the oblique-feed rollers is prevented, and it is possible to perform skew-feed correction of the sheet S with high accuracy.

In this connection, the direction of a force that the oblique-feed roller 311 on the back side imparts to a sheet is inclined by a large amount relative to the sheet conveyance direction Dx compared to the oblique-feed rollers 321 to 323 on the front side. Therefore, in a case where the component V1$x$ in the sheet conveyance direction of the oblique-feeding velocity V1 generated by the oblique-feed roller 311 on the back side is set to be equal to the component V2$x$ generated by the oblique-feed rollers 321 to 323 on the front side, the component V1$y$ in the width direction becomes higher than the component V2$y$ generated by the oblique-feed rollers 321 to 323 on the front side (when V1$x$≈V2$x$, V1$y$>V2$y$). This fact is also advantageous when the back-side oblique-feed unit 31 shifts the sheet S quickly towards the side of the reference member 300 during a period from when pressing of the pairs of conveying rollers 21 is released (S113) until pressing by the front-side oblique-feed unit 32 is started (S114) (see FIG. 11A). On the other hand, when the oblique-feed rollers 321 to 323 on the front side are pressed, the moving velocity in the width direction generated by the oblique-feed rollers 321 to 323 on the front side for which the component of velocity in the width direction is smaller in comparison to the oblique-feed roller 311 on the back side is suppressed. This fact is advantageous for lessening the impact between the sheet S and the reference face 301 of the reference member 300.

(Inhibition of Turning after Skew-Feed Correction)

Next, the acceleration process of the oblique-feed rollers (S118), and the process for reducing the pressure force of the front-side oblique-feed unit 32 (S117) prior to the acceleration process will be described in detail. In general, although the productivity of the image forming apparatus increases as the conveying speed of sheets increases, on the other hand, the faster that the conveying speed is, the greater the impact when the sheets contact against the reference member and the greater the concern that buckling of sheets will occur. In the present embodiment, the oblique-feed rollers 321 to 323 of the front-side oblique-feed unit 32 are rotationally driven at a relatively slow speed until the relevant sheet contacts against the reference member 300, and the driving speed of the oblique-feed rollers 321 to 323 is increased after the sheet has contacted against the reference member 300.

In other words, after an operation that causes a sheet to contact against the abutment surface (first operation) by the second oblique-feed unit, an operation that increases the conveying speed of the sheet (second operation) is executed. In the first operation, when the driving speeds of the first oblique-feed unit and the second oblique-feed unit are described as a "first speed" and a "second speed", in the second operation the first oblique-feed unit is driven at a third speed that is higher than the first speed and the second oblique-feed unit is driven at a fourth speed that is higher than the second speed. By this means, the impact applied to the sheet at the time of contact is lessened, and productivity can also be ensured. Further, because the oblique-feeding velocities of the first oblique-feed unit and the second oblique-feed unit are accelerated together, it is difficult for turning of the sheet to occur in comparison with a case where only either one of the oblique-feeding velocities of the first oblique-feed unit and the second oblique-feed unit is accelerated. Note that, with respect to the oblique-feeding velocities V1 and V2 after acceleration also, the velocities can be set so that the components thereof in the sheet conveyance direction are equal (V1$x$≈V2$x$).

However, when performing the acceleration process, it is necessary to take care so that the posture of the sheet which underwent skew-feed correction by contacting against the reference member is not disturbed again. In a case where a sheet with a mass "m" is accelerated at an accelerated velocity "a" by acceleration of the oblique-feed rollers, a force of F=mxa (hereunder, referred to as "accelerating force F") acts on the sheet in comparison to the state before acceleration. At this time, in some cases a moment M attributable to the accelerating force F arises that attempts to turn the sheet (M=FxX; X: length of moment arm produced by accelerating force F), and the posture of the sheet is disturbed.

The behavior of the sheet due to this phenomenon is determined by the relation between the points of application of the accelerating force F and directions of the accelerating force F, and the center of the moment. The term "points of application of the accelerating force F" refers to the positions of contact between the respective oblique-feed rollers 311 and 321 to 323 and the sheet. The term "directions of the accelerating force F" refers to the rotational directions of the respective oblique-feed rollers at the positions of contact with the sheet. The term "center of the moment" refers to, in a case where the conveying resistance with respect to a sheet is divided by area with respect to a first face and a second face of the sheet, a position at which the respective conveying resistance amounts balance out, and is the apparent center of gravity position of the sheet. When it is assumed that the conveying resistance with respect to the sheet is uniform, the center of the moment matches the center of gravity position of the sheet. In practice, the center of the moment does not necessarily match the center of gravity position of the sheet due to factors such as differences in the coefficient of friction with respect to the sheet between the pairs of conveying rollers and the conveying guides or curves in the sheet conveyance path and the like. Experimentally, the center of the moment can be estimated by, for example, observing the turning direction of the sheet in a case where the sheet is accelerated while changing the conditions for the angle and position of only a single oblique-feed roller that is provided.

Figure 15A:
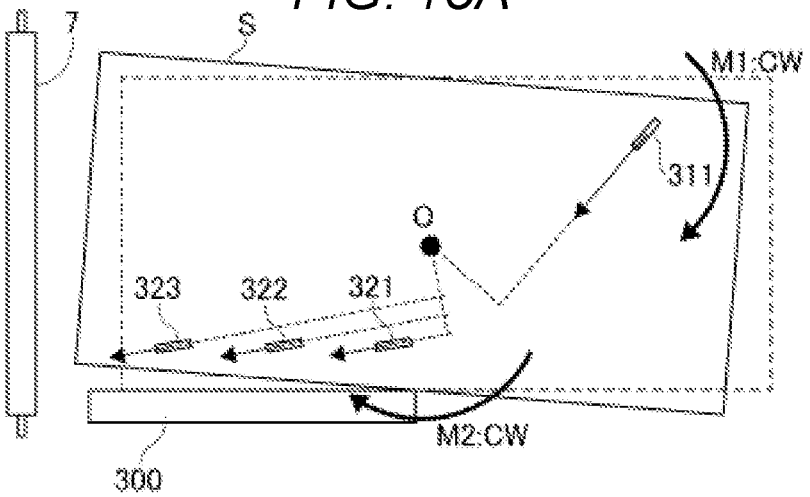
FIG. 15A and FIG. 15B are schematic diagrams for describing the arrangement of oblique-feed rollers and the behavior of a sheet in a reference example.
Figure 15B:
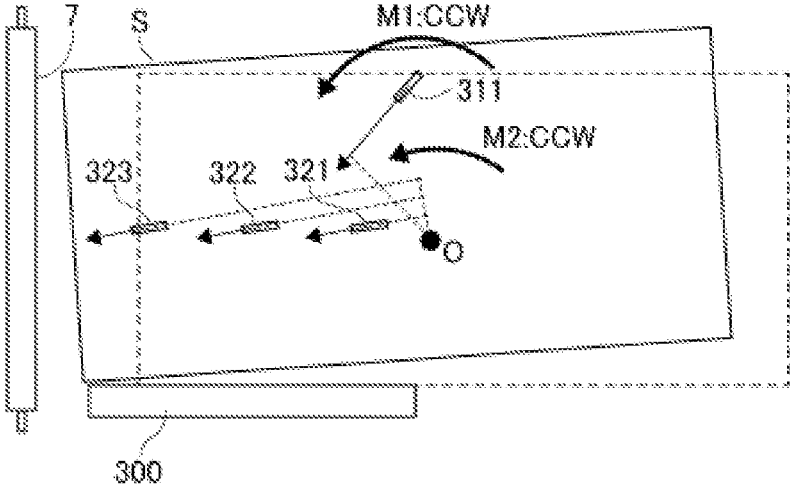
Figure 15C:
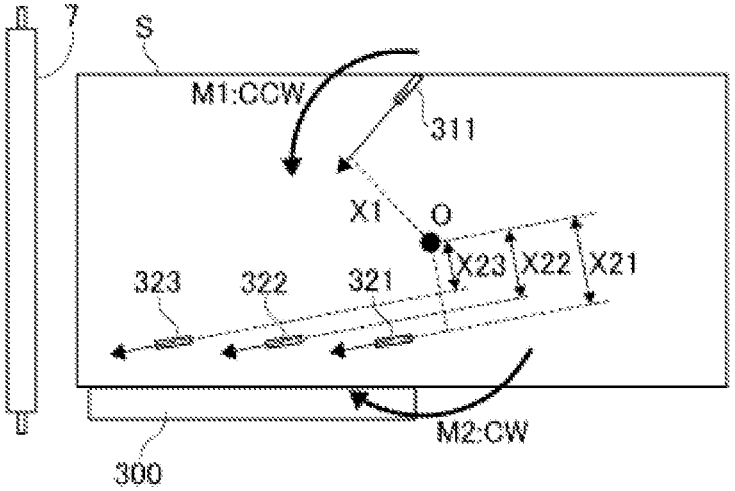
FIG. 15C is a schematic diagram for describing the arrangement of oblique-feed rollers and the behavior of a sheet in Embodiment 1.

Hereunder, a configuration for stabilizing the behavior of a sheet during the acceleration process will be described taking a point "O" shown in FIG. 15A, FIG. 15B and FIG. 15C as the center of a moment. FIG. 15A and FIG. 15B are schematic diagrams illustrating a skew-feed correction portion of a reference example in which the arrangement of oblique-feed rollers is different from the skew-feed correction portion 30 of the present embodiment that is illustrated in FIG. 15C.

In a case where moments M1 and M2 act on the sheet S due to acceleration of the front-side oblique-feed unit 32 and the back-side oblique-feed unit 31, the following three situations can be supposed:

(A) The oblique-feed rollers on the front side/back side each generate a moment in the clockwise rotation direction (CW) in FIG. 15A (FIG. 15A).

(B) The oblique-feed rollers on the front side/back side each generate a moment in the counterclockwise rotation direction (CCW) in FIG. 15B (FIG. 15B).

(C) The oblique-feed roller on the front side generates a moment in the clockwise rotation direction (CW) in FIG. 15C, and the oblique-feed rollers on the back side generate a moment in the counterclockwise rotation direction (CCW) in FIG. 15C (FIG. 15C).

In the case in (A), due to moments M1 and M2 in the clockwise rotation direction in FIG. 15A, accompanying the acceleration process the sheet S exhibits behavior in which the front end thereof turns in a direction away from the reference member 300. In the case in (B), due to moments M1 and M2 in the counterclockwise rotation direction in FIG. 15B, accompanying the acceleration process the sheet S exhibits behavior in which the rear end thereof turns in a direction away from the reference member 300. In the cases of both (A) and (B), moments attributable to acceleration of the oblique-feed units 31 and 32 on the front side and the back side act additively, and thus turning of the sheet is liable to occur.

On the other hand, in the case in (C), the accelerations of the front-side oblique-feed unit 32 and the back-side oblique-feed unit 31 generate moments in opposite directions to each other. In this case, because the moments caused by acceleration of the oblique-feed rollers on the front side and back side act so as to cancel each other out, it is difficult for turning of the sheet to occur, and the posture of the sheet during acceleration can be stabilized. In the present embodiment a configuration as described in (C) is adopted, that is, an arrangement in which the front-side oblique-feed unit 32 and the back-side oblique-feed unit 31 are positioned on one and the other side in the width direction with respect to the center 0 of a moment from when a sheet contacts against the reference member 300 until the sheet arrives at the registration rollers 7. Specifically, the front-side oblique-feed unit 32 is arranged on one side of the conveyance center L0 (see FIG. 2), and the back-side oblique-feed unit 31 is arranged on the other side of the conveyance center L0. By this means, moments generated by the respective oblique-feed units 31 and 32 cancel each other out, and the behavior of the sheet is stabilized.

In addition, in the present embodiment, in order to further stabilize the posture of a sheet during acceleration, processing is performed (see S117 in FIG. 9, and FIG. 10) that reduces the force with which the front-side oblique-feed unit 32 nips a sheet during acceleration. A difference in the numbers of oblique-feed rollers may be mentioned as one reason for performing this processing, and a difference in the length of moment arms may be mentioned as another reason.

With regard to the difference in the number of oblique-feed rollers, although the front-side oblique-feed unit 32 has the three oblique-feed rollers 321 to 323, the back-side oblique-feed unit 31 is constituted by the single oblique-feed roller 311. Consequently, in a state in which all of the oblique-feed rollers are in contact with a sheet, the moment M2 generated by the front-side oblique-feed unit 32 at acceleration is liable to become large in comparison to the moment M1 generated by the back-side oblique-feed unit 31. In this case, there is a possibility that the sheet S will turn in the clockwise rotation direction in FIG. 15C.

Further, with respect to the length of the arms of the moments, in the case of the present embodiment, the center O of the moment from when the sheet contacts against the reference member 300 until the sheet arrives at the registration rollers 7 is at a position that is in the vicinity of the conveyance center L0 and is also in the vicinity of the boundary between the pre-registration conveyance portion 20 and the skew-feed correction portion 30 (see FIG. 2). In such a case, in comparison to a case where the center O of the moment is at a position that is further upstream in the sheet conveyance direction, lengths X21, X22 and X23 of the moment arms generated by the oblique-feed rollers 321 to 323 on the front side are short, and a length X1 of the moment arm of the oblique-feed roller 311 on the back side becomes longer. Accordingly, in a case where conveying forces that the respective oblique-feed rollers impart to a sheet by acceleration of the oblique-feed units 31 and 32 have become large, the amount of increase in the moment M2 generated by the front-side oblique-feed unit 32 is liable to become larger than the amount of increase in the moment M1 generated by the back-side oblique-feed unit 31.

Based on this knowledge, in the present embodiment the pressure force of the front-side oblique-feed unit 32 is reduced before performing an acceleration process (S117 in FIG. 9). In other words, in a case of performing the second operation (S118) that accelerates the conveying speed of a sheet after the first operation (S114) that causes the sheet to contact against the abutment surface, the pressure force of the second oblique-feed unit in the second operation is set lower in comparison to the first operation. By this means, moments M1 and M2 that are generated in the latter half of a butting alignment operation, that is, moments M1 and M2 generated by the respective oblique-feed units 31 and 32 in a state after a sheet contacted against the reference member 300 are in balance (M1 M2), and it is difficult for turning of the sheet to occur.

The following methods (1) to (3) may be mentioned as methods for reducing the pressure force of the front-side oblique-feed unit 32.

(1) A method that weakens the pressure force of each of the three oblique-feed rollers.

(2) A method that releases the pressing of one or two of the three oblique-feed rollers.

(3) A method that releases the pressing of one or two of the three oblique-feed rollers, and weakens the pressure force of the remaining oblique-feed roller(s).

In the present embodiment, as shown in the "pressure force at accelerating" column in FIG. 10, one of the methods (1) to (3) is executed depending on the kind of sheet. By this means, regardless of the kind of sheet, a nipping pressure is set that prevents turning of a sheet and enables stable conveying of the sheet.

According to the sheet conveyance apparatus of Embodiment 1, productivity can be improved.

Embodiment 2

Figure 16:
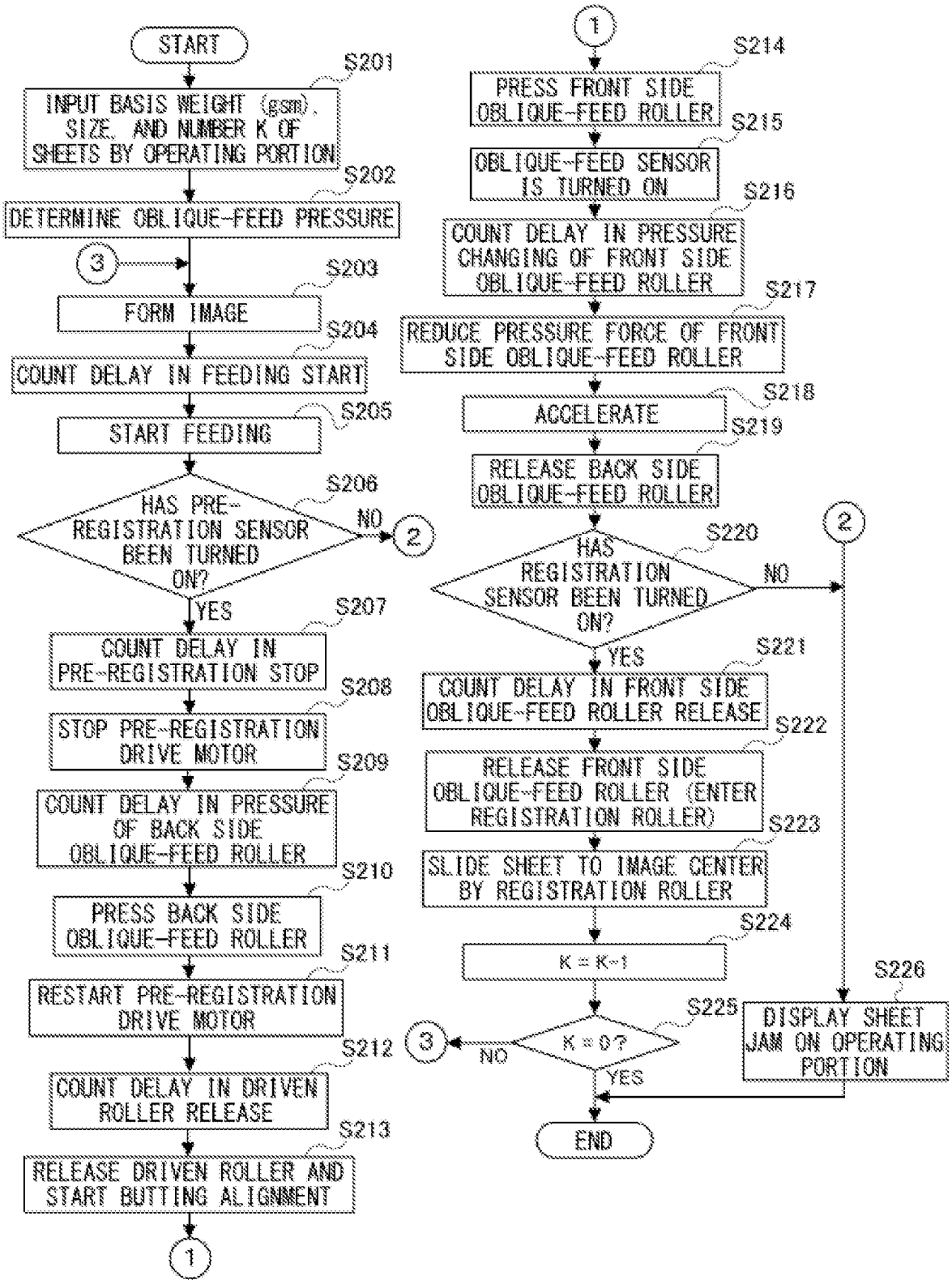
FIG. 16 is a flowchart illustrating a method for controlling a registration portion in Embodiment 2.

Next, a sheet conveyance apparatus according to Embodiment 2 will be described using FIG. 16. In a registration portion of the sheet conveyance apparatus in the present embodiment, the timing at which pressing of a back-side oblique-feed unit starts in a sheet conveying operation differs from the above described Embodiment 1. Since the remaining configuration is the same as Embodiment 1, elements that are common with Embodiment 1 are assigned the same reference symbols as in Embodiment 1 and a description of such elements is omitted hereunder. Hereinafter, a method for controlling a sheet conveying operation in the present embodiment is described following the flowchart shown in FIG. 16.

When an image formation job is started (S201) in a state in which information such as the basis weight, size and number of sheets that are the object of image formation has been input through the operating portion 412, the oblique-feed pressures of the front-side oblique-feed unit 32 and the back-side oblique-feed unit 31 are determined (S202). Unlike Embodiment 1, pressing of the back-side oblique-feed unit 31 is not started at this stage.

Thereafter, when an image forming operation by the image forming portions PY to PK is started (S203), a delay time period until the start of feeding is counted that is based on the start timing of the image forming operation (S204), and thereafter a sheet is fed from the feeding cassette 51 (S205). Subsequently, upon the pre-registration sensor 51 detecting that a sheet has been delivered to the pre-registration conveyance portion 20 (S206), a stop delay time period is counted (S207), and thereafter the pre-registration drive motor Mp is stopped (S208). Note that, in a case where the pre-registration sensor 51 does not detect a sheet even after a predetermined time period passes from the time that feeding started, a screen indicating there is a sheet jam is displayed on the operating portion (S226), and execution of the job ends.

Thereafter, a delay time period for starting pressing of the back-side oblique-feed unit 31 in conformity with the progress of the image forming operation is counted (S209), and the oblique-feed roller 311 of the back-side oblique-feed unit 31 is then pressed based on the oblique-feed pressure that was already determined (S210). Thereafter, driving of the pre-registration drive motor Mp that has been stopped is restarted (S211). Next, a delay time period until releasing pressing of the pairs of conveying rollers 21 of the pre-registration conveyance portion 20 is counted (S212), and then the driven rollers 24 separate from the driving rollers 23 and the respective pairs of conveying rollers 21 enter a separated state (S213).

In Embodiment 1, a sheet is fed into the skew-feed correction portion 30 from the pre-registration conveyance portion 20 in a state in which the back-side oblique-feed unit 31 has been pressure in advance. In contrast, in the present embodiment, and a configuration is adopted in which the start of pressing of the back-side oblique-feed unit 31 is delayed and a period (S210 to S212) in which the pairs of conveying rollers 21 of the pre-registration conveyance portion 20 and the oblique-feed roller 311 on the back side are simultaneously in a pressure state is made as short as possible. By this means, deterioration of rubber on the roller surface and damage to sheets that are caused by sliding friction between the oblique-feed roller 311 and the sheets can be reduced. Further, in the present embodiment also, as a result the timing for restarting driving of the pre-registration drive motor Mp is adjusted in conformity with the image forming operation, and hence variations in the time period until a sheet arrives at the pre-registration sensor S1 are absorbed.

Note that a configuration may also be adopted which starts pressing of the back-side oblique-feed unit 31 after restarting driving of the pre-registration drive motor Mp. Further, in order to reliably transfer a sheet from the pre-registration conveyance portion 20 to the skew-feed correction portion 30, the pairs of conveying rollers 21 can separate after starting pressing of the back-side oblique-feed unit 31.

When pressing of the pairs of conveying rollers 21 is released (S213), a butting alignment operation by the skew-feed correction portion 30 is started. That is, oblique feeding of the sheet by the back-side oblique-feed unit 31 is started, and the sheet is shifted to the side in the direction toward the reference face 301 of the reference member 300. Thereafter, at a timing at which the side edge of the sheet has come close to the reference face 301 of the reference member 300 to a certain extent, pressing of the oblique-feed rollers 321 to 323 on the front side is started based on the oblique-feed pressure that was already determined (S214). Thereupon, the sheet comes closer to the reference member 300, and the side edge of the sheet contacts against the reference face 301 to thereby correct a skew-feed of the sheet.

Thus, in the present embodiment also, the back-side oblique-feed unit 31 as a first oblique-feed unit and the front-side oblique-feed unit 32 as a second oblique-feed unit are used in combination. By this means, it is possible to contribute to downsizing and simplification of the apparatus by quickly shifting sheets to the side while lessening the impact of the sheets against the reference member 300 and preventing buckling of the sheets.

After pressing of the oblique-feed rollers 321 to 323 on the front side starts, upon the oblique-feed sensor S2 detecting the front end of the sheet (S215), a delay time period for changing the pressure force of the oblique-feed rollers 321 to 323 is counted (S216). Subsequently, after the delay time period elapses, processing that reduces the pressure force of the oblique-feed rollers 321 to 323 on the front side is executed (S217), and thereafter processing that increases the conveying speed of the front-side oblique-feed unit 32 and the back-side oblique-feed unit 31 is performed (S218).

At a timing that is set so as to be after acceleration is completed and prior to detection of the front end of the sheet by the registration sensor S3, pressing of the oblique-feed roller 311 on the back side is released and the oblique-feed roller 311 enters a released state (S219). By this means, a loop in the sheet is eliminated before the sheet enters the registration rollers 7. Upon the registration sensor S3 detecting the front end of the sheet (S220), a delay time period for releasing the oblique-feed rollers 321 to 323 on the front side is counted (S221), and then the pressing of the oblique-feed rollers 321 to 323 is released and the oblique-feed rollers 321 to 323 enter a released state (S222). The aforementioned delay time period is set so that the oblique-feed rollers 321 to 323 on the front side enter a released state after the front end of the sheet enters the nip portion of the registration rollers 7. Note that, if the registration sensor S3 does not detect a sheet within a predetermined time period, a screen indicating there is a sheet jam is displayed on the operating portion (S226), and execution of the job ends.

When the sheet is delivered to the registration rollers 7, the registration rollers 7 move in the width direction while conveying the sheet, and the center position of the sheet in the width direction is positioned in alignment with the center position of the image formed by the image forming portions PY to PK (S223). Upon the sheet being sent to the secondary transfer portion, a counter that manages the number of remaining sheets K that are to be subjected to image formation decrements the value of K (S224). If the number of remaining sheets K is not 0, that is, if sheets that are to be subjected to image formation remain (NO in S225), the above described operations (S203 to 5224) are repeated. When the number of remaining sheets K is 0 (YES in S225), it is determined that the image forming operation is completed, and execution of the job ends.

According to the sheet conveyance apparatus of Embodiment 2, productivity can be improved.

Embodiment 3

Next, a sheet conveyance apparatus according to Embodiment 3 will be described using FIG. 17 and FIG. 18. In a registration portion of the sheet conveyance apparatus of the present embodiment, the method for preventing turning of a sheet when accelerating the conveying speed of sheets in the case of conveying sheets made of thick paper or the like differs from the above-described Embodiment 2. Since the remaining configuration is the same as Embodiment 2, elements that are common with Embodiment 2 are assigned the same reference symbols as in Embodiment 2 and a description of such elements is omitted hereunder. Hereinafter, a method for controlling a sheet conveying operation in the present embodiment is described following the flowchart shown in FIG. 17 while referring as appropriate to FIG. 18.

When an image formation job is started (S301) in a state in which information such as the basis weight, size and number of sheets that are the object of image formation has been input through the operating portion 412, the oblique-feed pressures of the front-side oblique-feed unit 32 and the back-side oblique-feed unit 31 are determined (S302).

Thereafter, when an image forming operation by the image forming portions PY to PK is started (S303), a delay time period until the start of feeding is counted (S304) that is based on the start timing of the image forming operation, and thereafter a sheet is fed from the feeding cassette 51

(S305). Subsequently, upon the pre-registration sensor 51 detecting that a sheet has been delivered to the pre-registration conveyance portion 20 (S306), a stop delay time period is counted (S307), and thereafter the pre-registration drive motor Mp is stopped (S308). Note that, in a case where the pre-registration sensor 51 does not detect a sheet even after a predetermined time period passes from the time that feeding started, a screen indicating there is a sheet jam is displayed on the operating portion (S326), and execution of the job ends.

Thereafter, a delay time period for starting pressing of the back-side oblique-feed unit 31 in conformity with the progress of the image forming operation is counted (S309), and the oblique-feed roller 311 of the back-side oblique-feed unit 31 is then pressed based on the oblique-feed pressure that was already determined (S310). Thereafter, driving of the pre-registration drive motor Mp that has been stopped is restarted (S311). Next, a delay time period until releasing pressing of the pairs of conveying rollers 21 of the pre-registration conveyance portion 20 is counted (S312), and then the driven rollers 24 separate from the driving rollers 23 and the respective pairs of conveying rollers 21 enter a separated state (S313).

When pressing of the pairs of conveying rollers 21 is released (S313), a butting alignment operation by the skew-feed correction portion 30 is started. That is, oblique feeding of the sheet by the back-side oblique-feed unit 31 is started, and the sheet is shifted to the side in the direction toward the reference face 301 of the reference member 300. Thereafter, at a timing at which the side edge of the sheet has come close to the reference face 301 of the reference member 300 to a certain extent, pressing of the oblique-feed rollers 321 to 323 on the front side is started based on the oblique-feed pressure that was already determined (S314). Thereupon, the sheet comes closer to the reference member 300, and the side edge of the sheet contacts against the reference face 301 to thereby correct a skew-feed of the sheet.

Thus, in the present embodiment also, the back-side oblique-feed unit 31 as a first oblique-feed unit and the front-side oblique-feed unit 32 as a second oblique-feed unit are used in combination. By this means, it is possible to contribute to downsizing and simplification of the apparatus by quickly shifting sheets to the side while lessening the impact of the sheets against the reference member 300 and preventing buckling of the sheets.

In this case, in the present embodiment, after pressing of the oblique-feed rollers 321 to 323 on the front side starts, upon the oblique-feed sensor S2 detecting the front end of the sheet (S315), a delay time period for changing the pressure force of the oblique-feed roller 311 on the back side is counted (S316). Subsequently, after the delay time period elapses, processing that reduces the pressure force of the oblique-feed roller 311 on the back side is executed (S317), and thereafter processing that increases the conveying speed of the front-side oblique-feed unit 32 and the back-side oblique-feed unit 31 is performed (S318).

As described above, when an acceleration process that increases the sheet conveying speed is performed, in some cases a moment arises which attempts to turn the sheet that is due to a difference in the number of oblique-feed rollers on the front side and the back side and a difference in the inclination angle with respect to the sheet conveyance direction (difference in the length of the moment arms). In Embodiment 1, the moment M1 generated by the front-side oblique-feed unit 32 at the time of acceleration is suppressed and made to balance with the moment M2 generated by the back-side oblique-feed unit by reducing the force with which the front-side oblique-feed unit 32 nips the sheet.

However, for example, in the case of a sheet for which the conveying resistance is relatively large, such as a thick sheet, there is a concern that when the pressure force of the oblique-feed rollers 321 to 323 on the front side is reduced, conveying of the sheet will be delayed or the stability of the conveying operation will decrease due to an insufficient conveying force. Therefore, in the present embodiment, in the case of conveying a sheet having a basis weight of 300 gsm (grams per square meter) or more, the pressure force of the oblique-feed roller 311 on the back side is increased without decreasing the pressure force of the oblique-feed rollers 321 to 323 on the front side (see the lowest row in FIG. 18). That is, in the present embodiment, in a case where a second operation (S318) that accelerates the conveying speed of a sheet is performed after a first operation (S314) that causes the sheet to contact against the abutment surface, the pressure force of the first oblique-feed unit in the second operation is set higher in comparison to the first operation.

By this means, a force with which the back-side oblique-feed unit 31 nips the sheet is large, and the moment M1 generated by the back-side oblique-feed unit 31 during acceleration increases, and therefore the moment M1 can be made to balance with the moment M2 generated by the front-side oblique-feed unit 32 (see FIG. 15C). Therefore, it is possible to reduce turning of the sheet during acceleration while preventing a shortage in the conveying force, and to thus perform stable skew-feed correction.

Figure 17:
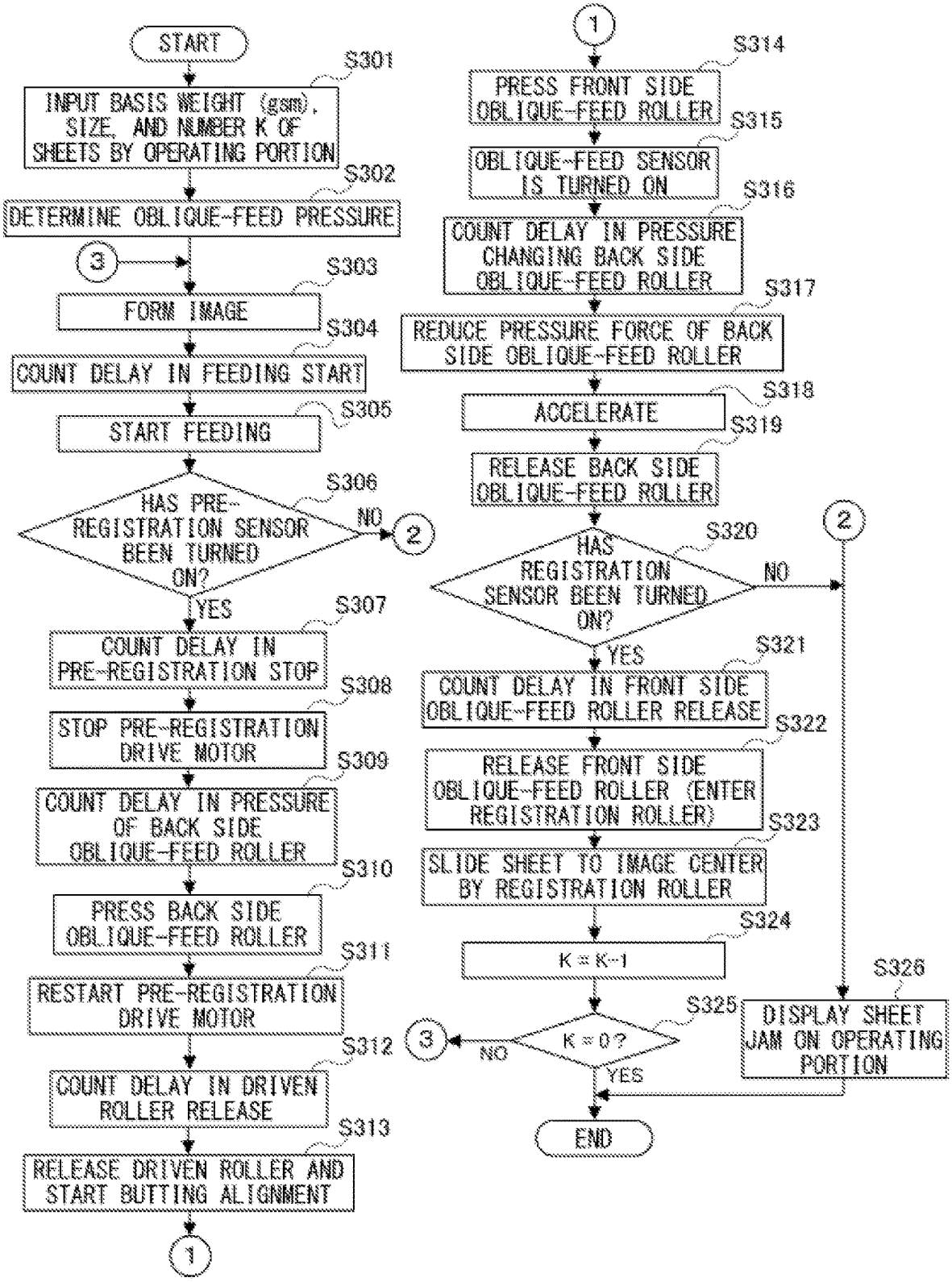
FIG. 17 is a flowchart illustrating a method for controlling a registration portion in Embodiment 3.

Note that, the flowchart illustrated in FIG. 17 is a flowchart that is executed in a case where the basis weight of a sheet is 300 gsm or more. In the case of a sheet having a basis weight that is less than 300 gsm, the same control as in Embodiment 2 is performed. That is, with respect to a sheet having a basis weight that is less than 300 gsm, processing that reduces the pressure force of the front-side oblique-feed unit 32 prior to the acceleration process is performed (S217 in FIG. 16). By this means, with respect to relatively thin sheets, the condition for the oblique-feed roller 311 on the back side is one that allows slipping to easily occur, and the occurrence of excessive loops that cause creases or skews at the registration rollers 7 can be suppressed. Thus, according to the present embodiment, a mode that sets the pressure force of the first oblique-feed unit during acceleration to a high value and a mode that sets the pressure force of the second oblique-feed unit during acceleration to a low value are selectively used as appropriate according to the basis weight of the sheets.

The description will now be continued by returning again to the flowchart in FIG. 17. At a timing that is set so as to be after acceleration is completed and prior to detection of the front end of the sheet by the registration sensor S3, pressing of the oblique-feed roller 311 on the back side is released and the oblique-feed roller 311 enters a released state (S319). By this means, a loop in the sheet is eliminated before the sheet enters the registration rollers 7. Upon the registration sensor S3 detecting the front end of the sheet (S320), a delay time period for releasing the oblique-feed rollers 321 to 323 on the front side is counted (S321), and then the pressing of the oblique-feed rollers 321 to 323 is released and the oblique-feed rollers 321 to 323 enter a released state (S322). The aforementioned delay time period is set so that the oblique-feed rollers 321 to 323 on the front side enter a released state after the front end of the sheet enters the nip portion of the registration rollers 7. Note that, if the registration sensor S3 does not detect a sheet within a predetermined time period, a screen indicating there is a sheet jam is displayed on the operating portion (S326), and execution of the job ends.

When the sheet is delivered to the registration rollers 7, the registration rollers 7 move in the width direction while conveying the sheet, and the center position of the sheet in the width direction is positioned in alignment with the center position of the image formed by the image forming portions PY to PK (S323). Upon the sheet being sent to the secondary transfer portion, a counter that manages the number of remaining sheets K that are to be subjected to image formation decrements the value of K (S324). If the number of remaining sheets K is not 0, that is, if sheets that are to be subjected to image formation remain (NO in S325), the above described operations (S303 to 5324) are repeated. When the number of remaining sheets K is 0 (YES in S325), it is determined that the image forming operation is completed, and execution of the job ends.

According to the sheet conveyance apparatus of Embodiment 3, productivity can be improved.

Embodiment 4

Next, a sheet conveyance apparatus according to Embodiment 4 will be described using FIG. 19 and FIG. 20. A difference between a registration portion of the sheet conveyance apparatus of the present embodiment and the above described Embodiment 3 concerns a method for controlling a sheet conveying operation in the case of conveying some sheets that include extremely thin paper that is adopted in the present embodiment. Since the remaining configuration is the same as Embodiment 3, elements that are common with Embodiment 3 are assigned the same reference symbols as in Embodiment 3 and a description of such elements is omitted hereunder. Hereinafter, a method for controlling a sheet conveying operation in the present embodiment is described following the flowchart shown in FIG. 19 while referring as appropriate to FIG. 20.

When an image formation job is started (S401) in a state in which information such as the basis weight, size and number of sheets that are the object of image formation has been input through the operating portion 412, the oblique-feed pressures of the front-side oblique-feed unit 32 and the back-side oblique-feed unit 31 are determined (S402).

Thereafter, when an image forming operation by the image forming portions PY to PK is started (S403), a delay time period until the start of feeding is counted (S404) that is based on the start timing of the image forming operation, and thereafter a sheet is fed from the feeding cassette 51 (S405). Subsequently, upon the pre-registration sensor 51 detecting that a sheet has been delivered to the pre-registration conveyance portion 20 (S406), a stop delay time period is counted (S407), and thereafter the pre-registration drive motor Mp is stopped (S408). Note that, in a case where the pre-registration sensor 51 does not detect a sheet even after a predetermined time period passes from the time that feeding started, a screen indicating there is a sheet jam is displayed on the operating portion (S426), and execution of the job ends.

Thereafter, a delay time period for starting pressing of the back-side oblique-feed unit 31 in conformity with the progress of the image forming operation is counted (S409), and the oblique-feed roller 311 of the back-side oblique-feed unit 31 is then pressed based on the oblique-feed pressure that was already determined (S410). Thereafter, driving of the pre-registration drive motor Mp that has been stopped is restarted (S411). Next, a delay time period until releasing pressing of the pairs of conveying rollers 21 of the pre-registration conveyance portion 20 is counted (S412), and then the driven rollers 24 separate from the driving rollers 23 and the respective pairs of conveying rollers 21 enter a separated state (S413).

When pressing of the pairs of conveying rollers 21 is released (S413), a butting alignment operation by the skew-feed correction portion 30 is started. That is, oblique feeding of the sheet by the back-side oblique-feed unit 31 is started, and the sheet is shifted to the side in the direction toward the reference face 301 of the reference member 300. Thereafter, at a timing at which the side edge of the sheet has come close to the reference face 301 of the reference member 300 to a certain extent, pressing of the oblique-feed rollers 321 to 323 on the front side is started based on the oblique-feed pressure that was already determined (S414). Thereupon, the sheet comes closer to the reference member 300, and the side edge of the sheet contacts against the reference face 301 to thereby correct a skew-feed of the sheet.

Thus, in the present embodiment also, the back-side oblique-feed unit 31 as a first oblique-feed unit and the front-side oblique-feed unit 32 as a second oblique-feed unit are used in combination. By this means, it is possible to contribute to downsizing and simplification of the apparatus by quickly shifting sheets to the side while lessening the impact of the sheets against the reference member 300 and preventing buckling of the sheets.

In this case, in the present embodiment, after pressing of the oblique-feed rollers 321 to 323 on the front side starts, upon the oblique-feed sensor S2 detecting the front end of the sheet (S415), a delay time period for releasing the pressing of the back-side oblique-feed unit 31 is counted (S416). Subsequently, after the delay time period elapses, processing that releases the pressing of the oblique-feed roller 311 on the back side is executed (S417), and thereafter processing that increases the conveying speed of the front-side oblique-feed unit 32 and the back-side oblique-feed unit 31 is performed (S418).

In the case of a sheet for which the conveying resistance is small, such as an extremely thin sheet having a basis weight of 40 gsm or more and less than 60 gsm, although it is difficult for turning of the sheet to occur even if the sheet conveying speed is accelerated, on the other hand there is a concern that a loop will occur in the sheet due to the difference between the oblique-feeding directions of the oblique-feed units 31 and 32. That is, the sheet is drawn toward the reference member 300 by the oblique-feed roller 311 on the back side that has a large inclination angle with respect to the sheet conveyance direction, and a loop is liable to occur in the sheet while being conveyed between the oblique-feed units 31 and 32 on the back side and front side.

In the present embodiment, after the front end of the sheet is detected by the oblique-feed sensor S2, pressing of the back-side oblique-feed unit 31 is released (S417) before the acceleration process (S418). Therefore, a loop is eliminated before the front end of the sheet arrives at the registration rollers 7, and the occurrence of creasing or a skew-feed can be reduced.

On the other hand, in the case of sheets having a basis weight of 60 gsm or more, because the conveying resistance is relatively large it is preferable to reduce turning of the sheets when accelerating the sheet conveying speed. The flowchart illustrated in FIG. 19 is a flowchart executed in a case where the basis weight of the sheet is 40 gsm or more and less than 60 gsm, and the same control as in Embodiment 3 is performed for sheets having a basis weight of less than 60 gsm. That is, for sheets having a basis weight of 60 gsm or more and less than 300 gsm, processing that reduces the pressure force of the front-side oblique-feed unit 32 before acceleration is performed (see FIG. 20). Further, for sheets having a basis weight of 300 gsm or more, processing that increases the pressure force of the back-side oblique-feed unit 31 before acceleration is performed (see FIG. 20).

That is, in the present embodiment, switching between a first mode and a second mode is performed according to the basis weight of the relevant sheet, with a sheet conveying operation being executed in the first mode for sheets having a first basis weight and a sheet conveying operation being executed in the second mode for sheets having a second basis weight that is less than the first basis weight. However, the first mode is a mode which, even after an oblique-feed operation (first operation) with respect to a sheet is started by the front-side oblique-feed unit 32, starts an acceleration operation (second operation) while the back-side oblique-feed unit 31 is kept in a pressure state. Further, the second mode is a mode which, after an oblique-feed operation (first operation) with respect to a sheet is started by the front-side oblique-feed unit 32, switches the back-side oblique-feed unit 31 to a released state and then starts an acceleration operation (second operation).

Figure 19:
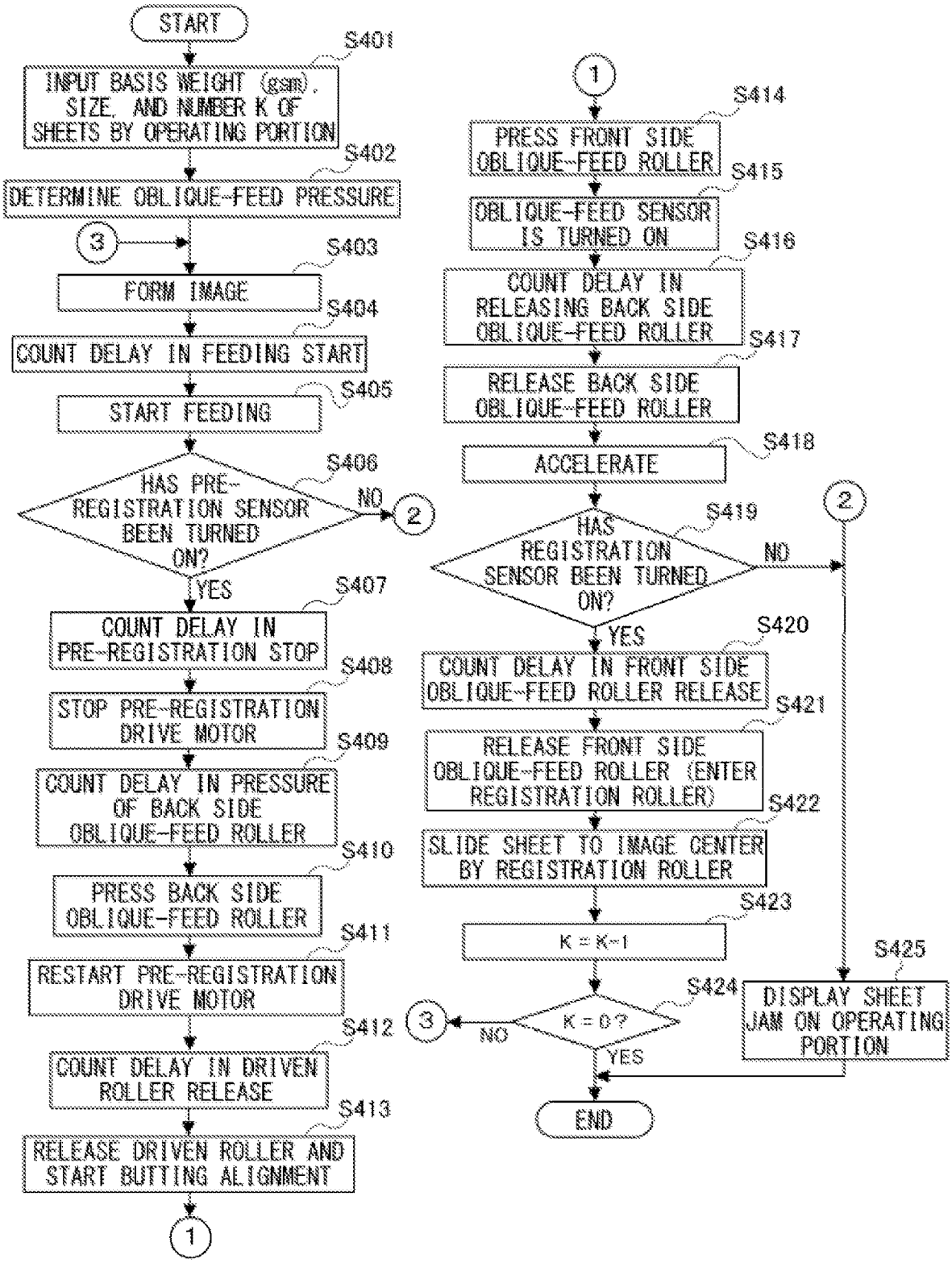
FIG. 19 is a flowchart illustrating a method for controlling a registration portion in Embodiment 4.

The description will now be continued by returning again to the flowchart in FIG. 19. Upon the registration sensor S3 detecting the front end of the sheet (S419), a delay time period for releasing the oblique-feed rollers 321 to 323 on the front side is counted (S420), and then the pressing of the oblique-feed rollers 321 to 323 is released and the oblique-feed rollers 321 to 323 enter a released state (S421). The aforementioned delay time period is set so that the oblique-feed rollers 321 to 323 on the front side enter a released state after the front end of the sheet enters the nip portion of the registration rollers 7. Note that, if the registration sensor S3 does not detect a sheet within a predetermined time period, a screen indicating there is a sheet jam is displayed on the operating portion (S425), and execution of the job ends.

When the sheet is delivered to the registration rollers 7, the registration rollers 7 move in the width direction while conveying the sheet, and the center position of the sheet in the width direction is positioned in alignment with the center position of the image formed by the image forming portions PY to PK (S422). Upon the sheet being sent to the secondary transfer portion, a counter that manages the number of remaining sheets K that are to be subjected to image formation decrements the value of K (S423). If the number of remaining sheets K is not 0, that is, if sheets that are to be subjected to image formation remain (NO in S424), the above described operations (S403 to S423) are repeated. When the number of remaining sheets K is 0 (YES in S424), it is determined that the image forming operation is completed, and execution of the job ends.

According to the sheet conveyance apparatus of Embodiment 4, productivity can be improved.

Embodiment 5

Next, a sheet conveyance apparatus according to Embodiment 5 will be described using FIG. 21, FIG. 22 and FIG. 23. A registration portion of the sheet conveyance apparatus in the present embodiment differs from the above described Embodiment 1 in that the back-side oblique-feed unit in the registration portion of the present embodiment has a plurality of oblique-feed rollers. Since the remaining configuration is the same as Embodiment 1, elements that are common with Embodiment 1 are assigned the same reference symbols as in Embodiment 1 and a description of such elements is omitted hereunder.

Figure 21:
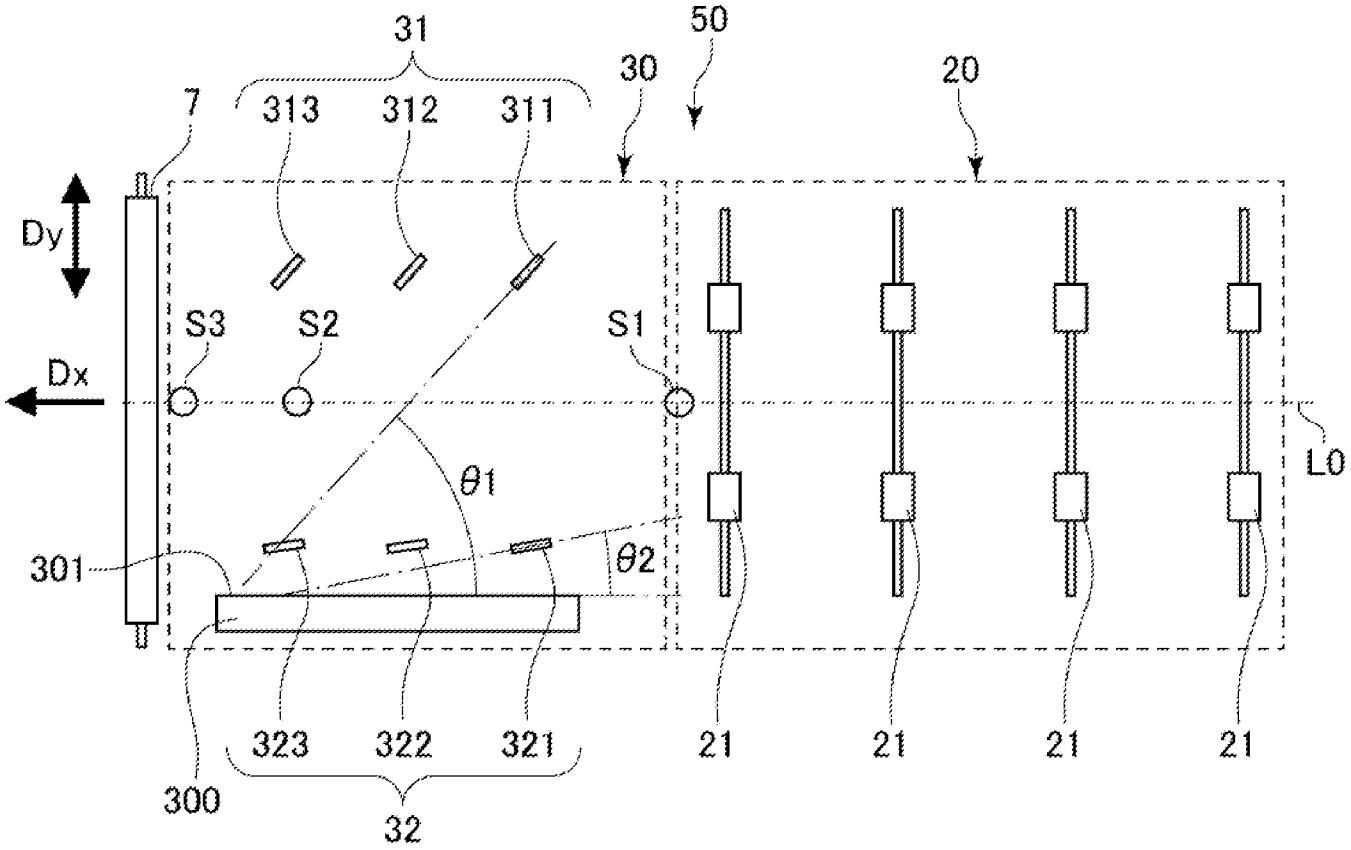
FIG. 21 is a plan view illustrating an outline of a registration portion according to Embodiment 5.
Figure 22:
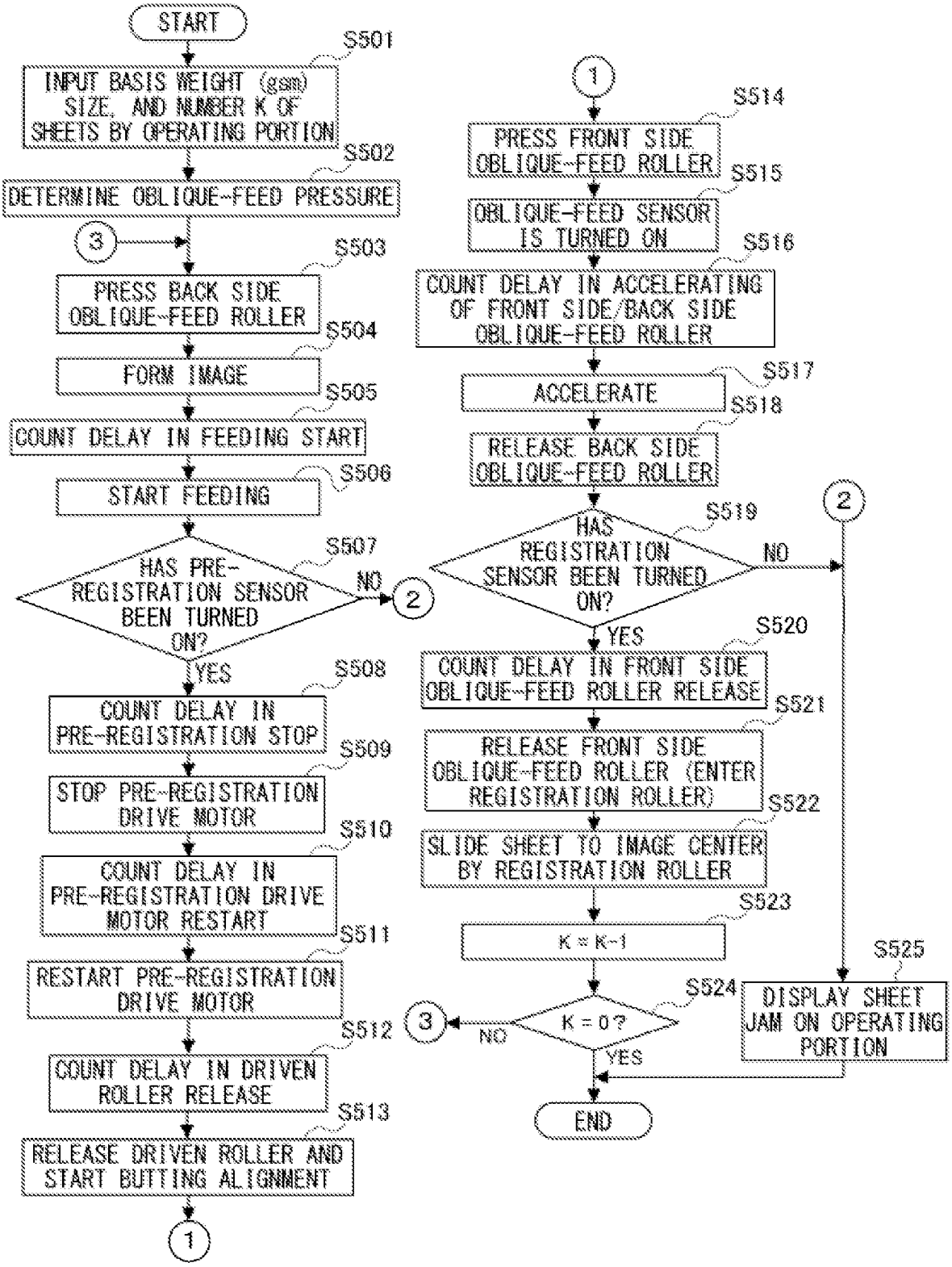
FIG. 22 is a flowchart illustrating a method for controlling a registration portion in Embodiment 5.

As illustrated in FIG. 21, a back-side oblique-feed unit 31 having three oblique-feed rollers 311, 312 and 313 is disposed in the skew-feed correction portion 30 of the present embodiment. The respective oblique-feed rollers 311 to 313 are disposed so that, toward the downstream side in the sheet conveyance direction Dx, the oblique-feed rollers 311 to 313 are parallel to each other along a direction in which the oblique-feed rollers 311 to 313 are inclined so as to approach the reference member 300 in the width direction Dy. Similarly to Embodiment 1, the oblique-feed rollers 311 to 313 on the back side are disposed so that the angle with respect to the sheet conveyance direction Dx of the direction of a conveying force imparted to a sheet is larger in comparison to the corresponding angle of the oblique-feed rollers 321 to 323 on the front side ($\theta 1 > \theta 2$).

A driven roller opposes each of the oblique-feed rollers 311 to 313 of the back-side oblique-feed unit 31, and the respective driven rollers are adapted so as to be switchable between a pressure state and a released state by the pressing mechanism 33 that is that same as the pressing mechanism illustrated in FIG. 6A, FIG. 6B, FIG. 7A and FIG. 7B. Hereunder, a method for controlling a sheet conveying operation in the present embodiment is described following the flowchart in FIG. 22 while referring as appropriate to FIG. 23.

When an image formation job is started (S501) in a state in which information such as the basis weight, size and number of sheets that are the object of image formation has been input through the operating portion 412, the oblique-feed pressures of the front-side oblique-feed unit 32 and the back-side oblique-feed unit 31 are determined (S502). Based on the determined oblique-feed pressures, first, pressing of the oblique-feed rollers 311 to 313 on the back side is started to enter a pressure state (S503). As illustrated in the table in FIG. 23, the size of the oblique-feed pressure is determined according to the basis weight of the sheet so as to enable stable conveying irrespective of the kind of sheet.

Thereafter, when an image forming operation by the image forming portions PY to PK is started (S504), a delay time period until the start of feeding is counted (S505) that is based on the start timing of the image forming operation, and thereafter a sheet is fed from the feeding cassette 51 (S506). Subsequently, upon the pre-registration sensor 51 detecting that a sheet has been delivered to the pre-registration conveyance portion 20 (S507), a stop delay time period is counted (S508), and thereafter the pre-registration drive motor Mp is stopped (S509). Note that, in a case where the pre-registration sensor S1 does not detect a sheet even after a predetermined time period passes from the time that feeding started, a screen indicating there is a sheet jam is displayed on the operating portion (S525), and execution of the job ends.

Thereafter, a delay time period until restarting in conformity with the progress of the image forming operation is counted (S510), and driving of the pre-registration drive motor Mp is restarted (S511). Because the timing for restarting driving by the pre-registration drive motor Mp is adjusted in conformity with the image forming operation, variations in the time period until a sheet arrives at the pre-registration sensor S1 are absorbed. Thereafter, a delay time period until pressing of the pairs of conveying rollers 21 of the pre-registration conveyance portion 20 is released is counted (S512), and then the driven rollers 24 separate from the driving rollers 23 and the respective pairs of conveying rollers 21 enter a separated state (S513).

When pressing of the pairs of conveying rollers 21 is released (S513), a butting alignment operation by the skew-feed correction portion 30 is started. That is, oblique feeding of the sheet by the back-side oblique-feed unit 31 is started, and the sheet is shifted to the side in the direction toward the reference face 301 of the reference member 300. Thereafter, at a timing at which the side edge of the sheet has come close to the reference face 301 of the reference member 300 to a certain extent, pressing of the oblique-feed rollers 321 to 323 on the front side is started based on the oblique-feed pressure that was already determined (S514). Thereupon, the sheet comes closer to the reference member 300, and the side edge of the sheet contacts against the reference face 301 to thereby correct a skew-feed of the sheet.

Thus, in the present embodiment also, the back-side oblique-feed unit 31 as a first oblique-feed unit and the front-side oblique-feed unit 32 as a second oblique-feed unit are used in combination. By this means, it is possible to contribute to downsizing and simplification of the apparatus by quickly shifting sheets to the side while lessening the impact of the sheets against the reference member 300 and preventing buckling of the sheets.

Further, when adopting a configuration in which the first oblique-feed unit has a plurality of oblique-feed rollers as in the present embodiment, in comparison to a case where the first oblique-feed unit has one oblique-feed roller it is easier to secure a conveying force for shifting a sheet toward the side, and even in the case of thicker sheets, the sheets can be stably shifted to the side of the reference member. In addition, because the pressure force of the individual oblique-feed rollers can be kept small, deterioration of rubber on the surface of the rollers and damage to sheets that are caused by sliding friction between the sheets and oblique-feed rollers can be suppressed.

After starting pressing of the oblique-feed rollers 321 to 323 on the front side, when the oblique-feed sensor S2 detects the front end of the sheet (S515), a delay time period for changing the driving speed of the oblique-feed units 31 and 32 is counted (S516). Subsequently, after the delay time period elapses, processing is performed that increases the conveying speed of the front-side oblique-feed unit 32 and the back-side oblique-feed unit 31 (S517).

Note that, in the present embodiment, because the number of oblique-feed rollers is equal between the oblique-feed units 31 and 32 on the front side and back side, processing that changes the pressure force of the oblique-feed rollers during acceleration is not performed. This is because, according to this configuration, moments that accompany acceleration cancel each other out and naturally balance. However, in a case where the balance between the moments is lost (for example, in a case where there is a large difference in the length of the moment arm between oblique-feed units 31 and 32 on the front side and back side), it is possible to adjust the pressure force of one or both of the oblique-feed units 31 and 32 in the acceleration operation.

At a timing that is set so as to be after acceleration is completed and prior to detection of the front end of the sheet by the registration sensor S3, pressing of the oblique-feed rollers 311 to 313 on the back side is released and the oblique-feed rollers 311 to 313 enter a released state (S518). By this means, a loop in the sheet is eliminated before the sheet enters the registration rollers 7. Upon the registration sensor S3 detecting the front end of the sheet (S519), a delay time period for releasing the oblique-feed rollers 321 to 323 on the front side is counted (S520), and then the pressing of the oblique-feed rollers 321 to 323 is released and the oblique-feed rollers 321 to 323 enter a released state (S521). The aforementioned delay time period is set so that the oblique-feed rollers 321 to 323 on the front side enter a released state after the front end of the sheet enters the nip portion of the registration rollers 7. Note that, if the registration sensor S3 does not detect a sheet within a predetermined time period, a screen indicating there is a sheet jam is displayed on the operating portion (S525), and execution of the job ends.

When the sheet is delivered to the registration rollers 7, the registration rollers 7 move in the width direction while conveying the sheet, and the center position of the sheet in the width direction is positioned in alignment with the center position of the image formed by the image forming portions PY to PK (S522). Upon the sheet being sent to the secondary transfer portion, a counter that manages the number of remaining sheets K that are to be subjected to image formation decrements the value of K (S523). If the number of remaining sheets K is not 0, that is, if sheets that are to be subjected to image formation remain (NO in S524), the above described operations (S503 to S523) are repeated. When the number of remaining sheets K is 0 (YES in S524), it is determined that the image forming operation is completed, and execution of the job ends.

According to the sheet conveyance apparatus of Embodiment 5, productivity can be improved.

Other Embodiments

Although in the foregoing Embodiments 1 to 5 a registration portion that is arranged upstream of a transfer portion at which transferring of images is performed is described as an example of a sheet conveyance apparatus, the present technology is also applicable to other sheet conveyance apparatuses that adopt a side registration method. For example, the present technology can be used as an apparatus which conveys sheets while correcting skew-feed of the sheets inside a sheet processing apparatus that is connected to the main body of an image forming apparatus, or as an apparatus which conveys sheets while correcting skew-feed of the sheets in the two-sided conveyance portion 502 (see FIG. 1). That is, a sheet conveyance apparatus is not limited to an apparatus that is housed in the main body of an image forming apparatus or to an apparatus that is used for sheet conveyance prior to image formation.

Further, elements described in the respective exemplary embodiments can be combined with each other. For example, the configuration of the skew-feed correction portion 30 of Embodiment 5 may be used to perform the same control in any of Embodiments 1 to 4.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-143100, filed Jul. 24, 2017, which is hereby incorporated by reference herein in its entirety.

What is claimed is:

1. A sheet conveyance apparatus, comprising:

an abutment surface extending along a sheet conveyance direction and configured to abut against an edge, in a width direction orthogonal to the sheet conveyance direction, of a sheet which passes through a sheet conveyance path;

a first oblique-feed unit configured to convey the sheet by imparting to the sheet a force in a direction inclined relative to the sheet conveyance direction so that the sheet approaches the abutment surface in the width direction as the sheet proceeds downstream in the sheet conveyance direction;

a second oblique-feed unit disposed at a position closer to the abutment surface compared to the first oblique-feed unit in the width direction and configured to convey the sheet by imparting to the sheet a force in a direction inclined relative to the sheet conveyance direction so that the sheet approaches the abutment surface in the width direction as the sheet proceeds downstream in the sheet conveyance direction;

a first changeover unit configured to change over an abutment pressure of the first oblique-feed unit with respect to the sheet; and a control unit configured to execute a first operation in which the control unit drives the first oblique-feed unit at a first speed and drives the second oblique-feed unit at a second speed to cause the first oblique-feed unit and the second oblique-feed unit to convey the sheet and a second operation in which, after the sheet is abutted against the abutment surface by the first operation, the control unit drives the first oblique-feed unit at a third speed higher than the first speed and drives the second oblique-feed unit at a fourth speed higher than the second speed to cause the first oblique-feed unit and the second oblique-feed unit to convey the sheet, wherein the control unit controls the first changeover unit so that an abutment pressure of the first oblique-feed unit in the second operation is higher than an abutment pressure of the first oblique-feed unit in the first operation.

2. The sheet conveyance apparatus according to claim 1, further comprising a second changeover unit configured to change over an abutment pressure of the second oblique-feed unit with respect to the sheet, wherein the control unit controls the second changeover unit so that an abutment pressure of the second oblique-feed unit in the second operation is lower than an abutment pressure of the second oblique-feed unit in the first operation.

3. The sheet conveyance apparatus according to claim 1, wherein the second oblique-feed unit has a plurality of nip portions each configured to nip and convey the sheet, and at least a part of the plurality of nip portions are configured to be openable, and wherein the control unit puts the part of the plurality of nip portions into an open state in the second operation.

4. The sheet conveyance apparatus according to claim 1, wherein the first oblique-feed unit has at least one first roller which is rotatable around an axis extending in a direction inclined relative to the width direction, and wherein the second oblique-feed unit has a greater number of second rollers than a number of the at least one first roller, and the second rollers are rotatable around an axis extending in a direction inclined relative to the width direction.

5. The sheet conveyance apparatus according to claim 1, wherein a component of the first speed in the sheet conveyance direction and a component of the second speed in the sheet conveyance direction are approximately equal to each other, and wherein a component of the third speed in the sheet conveyance direction and a component of the fourth speed in the sheet conveyance direction are approximately equal to each other.

6. The sheet conveyance apparatus according to claim 1, further comprising:

a first conveyance unit disposed upstream of the first oblique-feed unit and the second oblique-feed unit and configured to convey the sheet in the sheet conveyance direction;

a second conveyance unit disposed downstream of the first oblique-feed unit and the second oblique-feed unit and configured to receive and convey the sheet from the second oblique-feed unit; and a detector configured to detect the sheet at a detection position between the first conveyance unit and the second conveyance unit in the sheet conveyance direction, wherein, after starting the first operation, the control unit starts the second operation after the sheet is detected by the detector.

7. The sheet conveyance apparatus according to claim 1, wherein the first oblique-feed unit is disposed on an opposite side to the abutment surface with respect to a center position of the sheet conveyance path in the width direction, and wherein the second oblique-feed unit is disposed on a same side as the abutment surface with respect to the center position of the sheet conveyance path in the width direction.

8. The sheet conveyance apparatus according to claim 1, wherein the first oblique-feed unit is adapted so as to impart to the sheet a force in a first direction which is inclined relative to the sheet conveyance direction so that the sheet approaches the abutment surface in the width direction as the sheet proceeds downstream in the sheet conveyance direction, and wherein the second oblique-feed unit is adapted so as to impart to the sheet a force in a second direction which is inclined relative to the sheet conveyance direction so that the sheet approaches the abutment surface in the width direction as the sheet proceeds downstream in the sheet conveyance direction, an inclination angle of the second direction with respect to the sheet conveyance direction being smaller than an inclination angle of the first direction with respect to the sheet conveyance direction.

9. The sheet conveyance apparatus according to claim 1, further comprising an image forming unit configured to form an image on the sheet which is butted against the abutment surface by the first oblique-feed unit and the second oblique-feed unit to correct a skew of the sheet.

* * * * *